US010507508B2

(12) United States Patent
Kimura et al.

(10) Patent No.: US 10,507,508 B2
(45) Date of Patent: Dec. 17, 2019

(54) PUNCH PRESS

(75) Inventors: Seiichi Kimura, Kanagawa (JP); Fumio Kato, Kanagawa (JP); Jun Hirono, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 823 days.

(21) Appl. No.: 13/516,541

(22) PCT Filed: Dec. 14, 2010

(86) PCT No.: PCT/JP2010/072426

§ 371 (c)(1),
(2), (4) Date: Jul. 27, 2012

(87) PCT Pub. No.: WO2011/074556

PCT Pub. Date: Jun. 23, 2011

(65) Prior Publication Data

US 2012/0279369 A1 Nov. 8, 2012

(30) Foreign Application Priority Data

Dec. 18, 2009 (JP) ..... 2009-287571
Feb. 16, 2010 (JP) ..... 2010-031091
May 11, 2010 (JP) ..... 2010-109323

(51) Int. Cl.
*B21D 28/26* (2006.01)
*B21D 28/12* (2006.01)
(Continued)

(52) U.S. Cl.
CPC ..... *B21D 28/26* (2013.01); *B21D 28/12* (2013.01); *B21D 28/34* (2013.01); *B21D 28/36* (2013.01);
(Continued)

(58) Field of Classification Search
CPC ..... Y10T 83/8733; Y10T 83/8732; Y10T 83/8739; Y10T 83/8748; Y10T 83/8727;
(Continued)

(56) References Cited

U.S. PATENT DOCUMENTS 2,002,437 A * 5/1935 Maul ..... B41L 47/46 101/47
3,392,913 A * 7/1968 Neilsen ..... B26F 1/04 234/98
(Continued)

FOREIGN PATENT DOCUMENTS

JP 4-129520 11/1992
JP 2000-94065 4/2000
(Continued)

OTHER PUBLICATIONS

Translation of JP2000218326, inventor Kato Fumio, Aug. 8, 2000.*
(Continued)

*Primary Examiner* — Jason Daniel Prone
*Assistant Examiner* — Samuel A Davies
(74) *Attorney, Agent, or Firm* — Greenblum & Bernstein, P.L.C.

(57) ABSTRACT

A punch press includes plural dies and plural punches, and punches a work by a punch and a die that are set at a work position. The punch press includes a lifter for lifting the die to be set at the work position up to a path line of the work, a die-support member movably provided on a die-side of the lifter, and a die supporter provided on the die-support member for supporting the die set at the work position in a state where the die has been selectively lifted up to the path line by the lifter. According to the punch press, contacts between a work and dies while conveying the work can be prevented.

3 Claims, 34 Drawing Sheets

(51) Int. Cl.
*B21D 28/34* (2006.01)
*B21D 28/36* (2006.01)

(52) U.S. Cl.
CPC ..... *Y10T 83/8732* (2015.04); *Y10T 83/8748* (2015.04)

(58) Field of Classification Search
CPC ..... B21D 28/36; B21D 37/14; B21D 28/12; B21D 28/26; B21D 28/34
USPC ..... 83/552, 553; 234/97, 98, 101, 99
See application file for complete search history.

(56) References Cited

U.S. PATENT DOCUMENTS 3,685,380 A * 8/1972 Daniels ..... B21D 28/12 408/35
4,989,483 A * 2/1991 Lacrouts-Cazenave ..... G06K 1/02 234/95
5,144,872 A * 9/1992 Kakimoto ..... B21D 28/246 234/114
5,616,112 A * 4/1997 Seto ..... B21D 28/12 483/29
5,862,733 A * 1/1999 Seto ..... B23Q 1/621 83/435.11
5,901,628 A * 5/1999 Sakamoto ..... B21D 28/12 83/552
6,769,600 B1 * 8/2004 Knox ..... B21D 28/22 234/98
2002/0038589 A1 * 4/2002 Kawai ..... B21D 28/12 83/164
2004/0154453 A1 * 8/2004 Kobayashi ..... B21D 28/12 83/691

FOREIGN PATENT DOCUMENTS

JP 2000-140957 5/2000
JP 2000-158061 6/2000
JP 2000-218326 8/2000
JP 2002-143947 5/2002
JP 2003-033832 2/2003
JP 2005-081409 3/2005

OTHER PUBLICATIONS

International Application Status Report with ISR dated Jan. 4, 2011.
Japan Office action, dated Feb. 4, 2014 along with an english translation thereof.
Japan Office Action cited 2003-338832 which appears to be incorrect.
Office Action issued in Counterpart European Patent Application No. 10837582.5-1016 dated Aug. 14, 2019.

* cited by examiner (a)

(b)

(a)

(b)

(a)

(b)

(a)

(b)

(a)

(b)

PUNCH PRESS

TECHNICAL FIELD

The present invent ion relates to a punch press which includes plural punches and plural dies and punches a work by a punch and a die that are set at a work position.

BACKGROUND ART

In a punch press that includes plural dies, when supplying a plate-shaped work above the dies by conveying it along a path line, a back surface of the work may contact with upper end surfaces of the dies and be subject to be damaged. A Patent Document 1 listed below discloses a punch press that can prevent this issue. In this punch press, upper end surfaces of the dies are preliminarily set below the path line of the work, and only a die requisite for punching is lifted up to the path line by a die elevating mechanism. At this time, the die that has been lifted up to the path line by the die elevating mechanism is supported by a spacer that is inserted into a lower portion of the die.

In addition, a Patent Document 2 listed below discloses a punch press that prevents damages of a work due to contacts with dies when conveying the work along upper positions of lower turrets. In this punch press, a flat-plate-shaped work support cover (a cover plate) is provided above the lower turrets. At punching positions on the cover plate, through-holes into which the dies can enter are provided. In addition, with the through-holes, shutters that can open/close the holes are provided. The contacts between the work and the dies upon conveying can be prevented by closing the through-holes with the shutters, so that damages of the work can be avoided. In addition, workings to the work can become workable by opening the shutters.

PRIOR ART DOCUMENT

Patent Document

[Patent Document 1] Japanese Patent Application Laid-Open No. 2000-218326

[Patent Document 2] Japanese Utility Model Application Laid-Open No. H4-129520

SUMMARY OF INVENTION

As described above, in a punch press, it is needed to prevent contacts between a work and dies when conveying the work not to damage the work.

An object of the present invention is to provide a punch press that can prevent contacts between a work and dies while conveying the work.

A first aspect of the present invention provides a punch press that includes a plurality of dies and a plurality of punches and punches a work by a punch and a die that are set at a work position, and includes a lifter for lifting the die to be set at the work position up to a path line of the work; a die-support member movably provided on a die-side of the lifter; and a die supporter provided on the die-support member for supporting the die set at the work position in a state where the die has been selectively lifted up to the path line by the lifter.

According to the first aspect, the die to be set at the work position is supported by the die supporter in a state where lifted up to the path line. Therefore, only a requisite die can be lifted up to the path line, and an unrequisite die can be held at a lower level than the path line while conveying the work. Thus, a bottom surface of the work conveyed on the path line can be prevented form damages due to contacts with the die.

A second aspect of the present invention provides a punch press that includes a plurality of dies and a plurality of punches and punches a work by a punch and a die that are set at a work position, and includes a work support cover for supporting the work; and a lifter for lifting the die to be set at the work position up to a path line of the work, wherein an opening is formed on the work support cover, the opening including an entering area into which, when the die to be set at the work position is lifted up to the path line, the die enters, a cover member that has an upper surface being flat with an upper surface of the work support cover is provided so as to move horizontally to close the opening, and the cover member is configured to move horizontally so as to make an end thereof close-to or distanced-from the entering area within the opening.

According to the second aspect, the opening is made narrower by making the end of the cover member close to the entering area of the die within the opening. Therefore, a bottom surface of the work conveyed on the path line can be prevented form damages due to contacts with the die.

DESCRIPTION OF EMBODIMENTS

Hereinafter, embodiments will be explained with reference to the drawings.

[First Embodiment]

Figure 1:
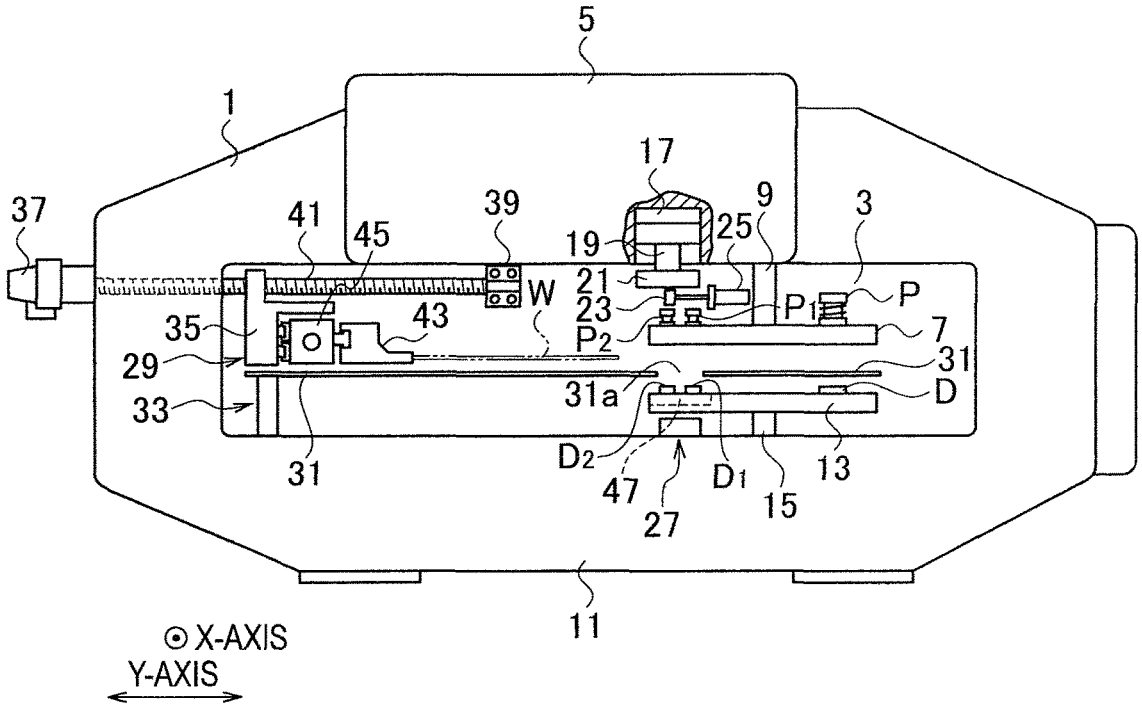
FIG. 1 It is a frond view showing an entire of a punch press according to a first embodiment.

FIG. 1 shows an entire of a turret punch press according to a first embodiment. This turret punch press includes a workspace 3 at a center of a main frame 1. An upper turret 7 to which plural punches P is installed is rotatably supported, via a rotary shaft 9, by an upper frame 5 located above the workspace 3.

A lower turret 13 to which plural dies D is installed is rotatably supported, via a rotary shaft 15, by a lower frame 11 located below the workspace 3. The upper turret 7 and the lower turret 11 can be rotationally stepped synchronously by a rotational stepping mechanism.

A vertical cylinder 17 is provided in the upper frame 5. A ram 21 is attached to a lower end of a piston rod 19 of the vertical cylinder 17. A striker 23 for performing punching by striking a punch P set at a work position is provided below the ram 21 so as to move horizontally in the drawing.

A shifting cylinder 25 for shifting a striker 23 horizontally is provided at the upper frame 5 in order to strike only a punch P to be used for punching (e.g. a punch $P_2$) among punches $P_1$ and $P_2$ aligned along a radial direction of the upper turret 7, for example.

On the other hand, a lifter 27 is provided at a work position on the lower frame 11 (i.e. at a position below a die D stepped for punching so as to work together with the above-mentioned punch P) in order to lifted up the dies D1 and D2 aligned, in association with the punches $P_1$ and $P_2$, along a radial direction of the lower turret 13.

In addition, an alignment unit 29 is provided on a left side of the upper turret 7 and the lower turret 13 in the drawing in order to move and set a work W as a material to be worked to the work position.

The alignment unit 29 includes a worktable 33 having brushes 46 (shown in an after-explained third embodiment: see FIG. 19) on its surface. The worktable 33 is constituted of a fixed table (a work support cover) 31 and movable tables 32 located at both sides of the fixed table 31 (shown in the after-explained third embodiment: see FIG. 18). A carriage base 35 is provided integrally with the movable tables so as to stride over the fixed table 31. The carriage base 35 can be moved along a Y-axis direction and then its position is set. The carriage base 35 is moved due to a rotation of a boll screw 41 rotatably supported by a motor 37 and a bearing 39 to set its position.

Note that, as shown in FIG. 1, the fixed table 31 is disposed from a left area of the lower turret 13 to an upper area of the lower turret 13. The movable tables 32 (see FIG. 18) moves on both sides of the fixed table 31 along the fixed table 31 in a state where the work W is laid thereon.

A carriage 45 having clampers 43 that for clamping the work W is provided on the carriage base 35. The carriage 45 can be moved along an X-axis direction by a shifting mechanism (not shown) and then its position is set.

Figure 19:
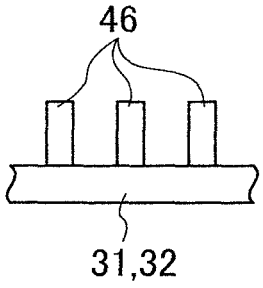
FIG. 19 It is a front view showing brushes mounted on surfaces of a fixed table and movable tables in the punch press.

Note that the brushes (damage restriction materials) 46 are mounted on the surfaces of the fixed table 31 and the movable tables 32 in order to restrict damages on a surface of the work W (see FIG. 19). The brushes 46 are mounted on an entire of the surfaces of the fixed table 31 and the movable tables 32 with constant heights.

According to configurations explained above, the work W clamped by the clamper 43 is set at the work position by movement and alignment along the Y-axis direction with the carriage base 35 and movement and alignment along the X-axis direction with the carriage 45.

On the other hand, the upper turret 7 and the lower turret 13 are synchronously rotated, so that the punch P (the punches $P_1$ and $P_2$) and the die D (the dies D1 and D2) to be used for punching are set at the work position. Subsequently, the striker 23 is struck to the punch P by the vertical cylinder 17 to punch out a desired portion on the work W.

Figure 2:
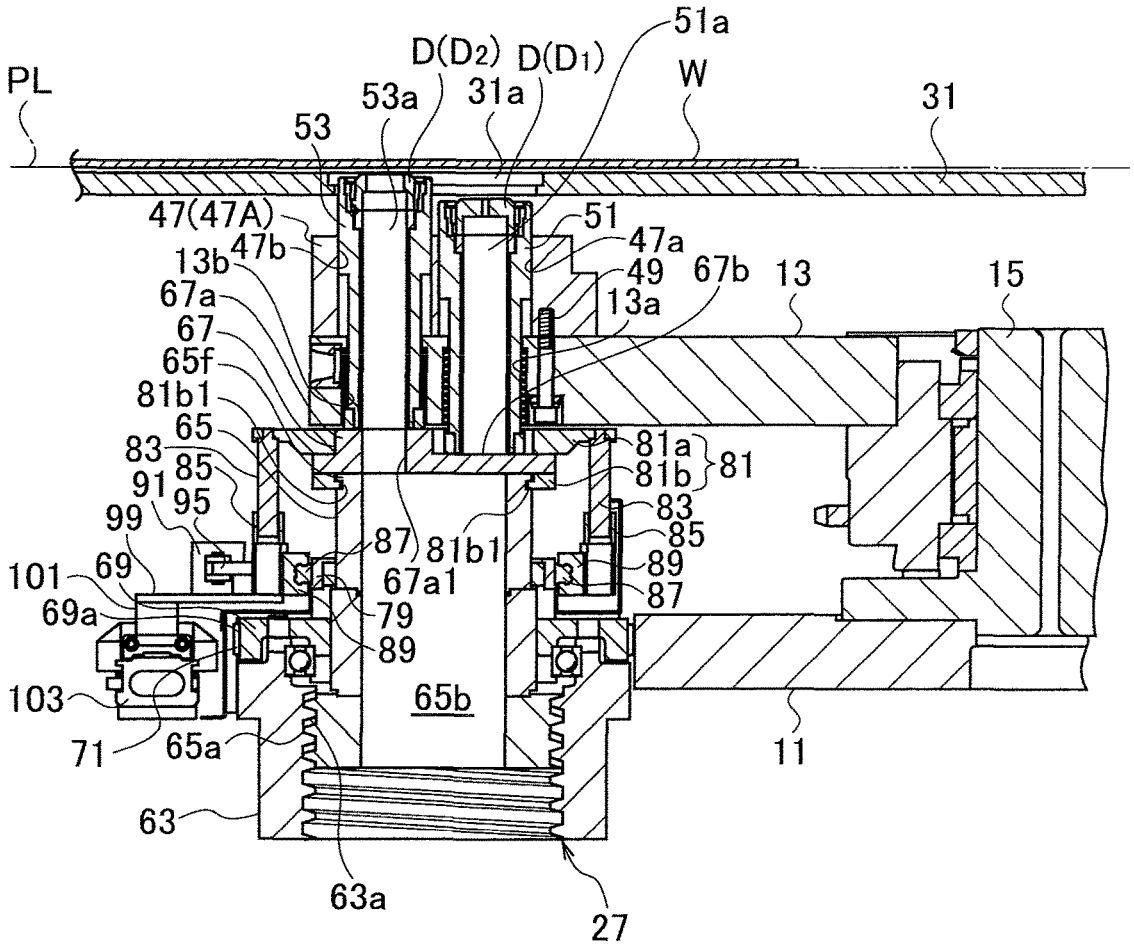
FIG. 2 It is a cross-sectional view showing a main portion of the punch press.
Figure 3:
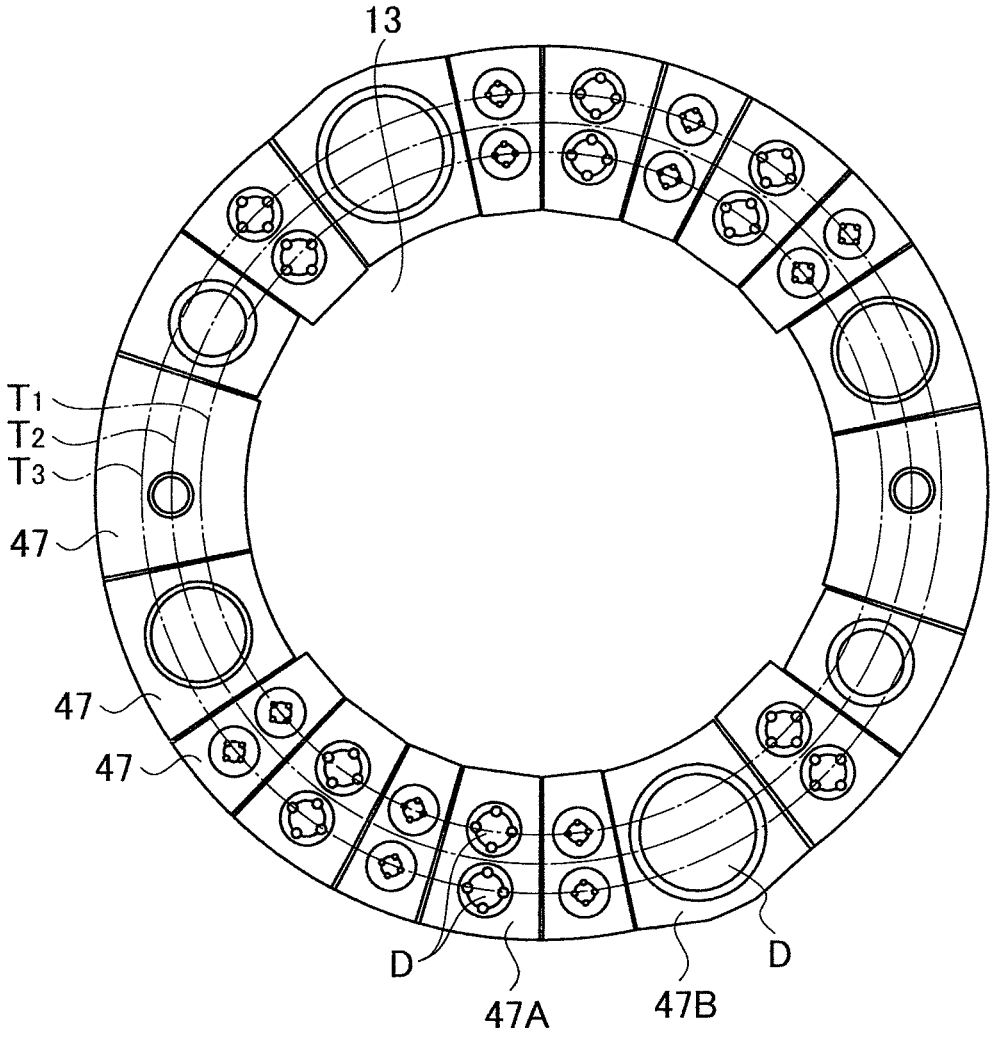
FIG. 3 It is a plan view showing lower turrets in the punch press.

The lower turret 13 has a circular plate shape as shown in FIG. 3. Die holders 47 are detachably attached to an outer circumferential side on an upper surface of the lower turret 13 by bolts 49 (see FIG. 2) along a circumferential direction. Different kinds of the dies D are detachably installed in the die holders 47, respectively.

Three concentric tracks $T_1$, $T_2$ and $T_3$ are provided in this order from an inner circumference to an outer circumference at attached positions on the die holders 47 of the lower turret 13. Each of the dies D in the die holders 47 is associated with any one of the three tracks $T_1$, $T_2$ and $T_3$ and arranged thereon. For example, in the die holder 47A, small-diameter dies D are attached on the inner circumferential track $T_1$ and the outer circumferential track $T_3$, respectively. In the die holder 47B, a large-diameter die D is attached on the center track $T_2$.

Therefore, the dies D1 and D2 aligned in the radial direction (see FIG. 1 and FIG. 2) correspond to the die D attached to the die holder 47A.

On the other hand, the upper turret 7 also has a circular plate shape. The upper turret 7 includes plural punch holders that are associated with the die holders 47 of the lower turret 13 along the circumferential direction, and the punches P are installed in the punch holders.

As explained above, the die holder 47 shown in FIG. 2 corresponds to the die holder 47A shown in FIG. 3. The die holder 47 (47A) includes the die $D_1$ associated with the inner circumferential track $T_1$ and the die $D_2$ associated with the outer circumferential track $T_3$. The die holder 47 is fixed to the lower turret 13 by the bolts 49 as explained above.

The dies D ($D_1$ and $D_2$) are installed in upper-end openings of cylindrical lifter pipes 51 and 53, respectively. The lifter pipe 51 is vertically-movably housed in a through hole 13*a* provided in the lower turret 13 and a through hole 47*a* provided in the die holder 47. The lifter pipe 53 is vertically-movably housed in a through hole 13*b* provided in the lower turret 13 and a through hole 47*b* provided in the die holder 47.

Figure 4:
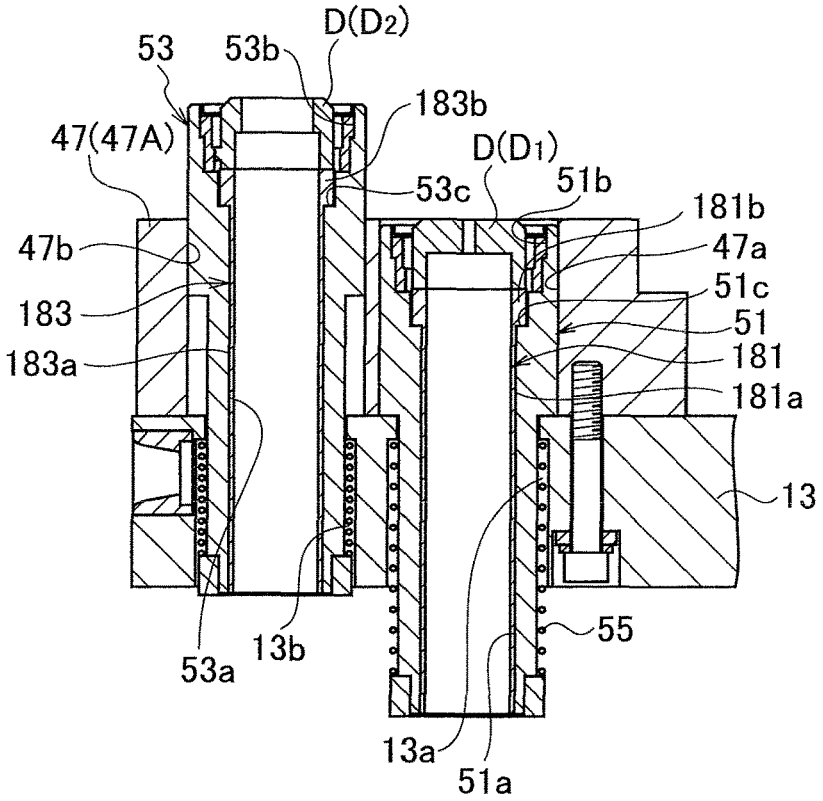
FIG. 4(*a*) is a cross-sectional view showing dies and a die holder on inside and outside tracks in the punch press, and (*b*) is cross-sectional view showing a die and a die holder on a center track.
Figure 4:
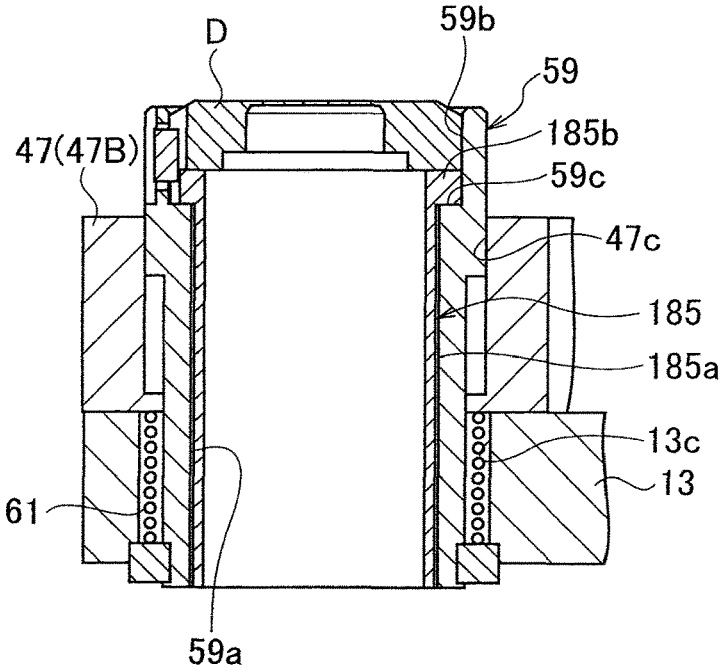

Each of the lifter pipes 51 and 53 is biased downward to the lower turret 13 by a spring 55 or 57 as shown in FIG. 4(*a*). Note that, in FIG. 4(*a*), the lifter pipe 51 is moved downward by the spring 55, and the lifter pipe 53 is lifted upward by the lifter 27 (explained in detail later) against an elastic force of the spring 57.

In addition, also with regard to the large-diameter die D provided in the die holder 47A in FIG. 3, a lifter pipe 59 is housed in a through hole 13*c* provided in the lower turret 13 and a through hole 47*c* provided in the die holder 47 as shown in FIG. 4(*b*) similarly to the above-explained small-diameter dies D ($D_1$ and $D_2$), and is biased downward by a spring 61. Note that, in FIG. 4 (*b*), the lifter pipe 59 is lifted upward by the lifter 27 against an elastic force of the spring 61.

Next, the lifter 27 for lifting up the lifter pipe 51, 53 or 59 together with the die D will be explained. A trapezoidal screw thread type lifting mechanism is adapted to the lifter 27. As shown in FIG. 2, a cylindrical female thread member 63 on whose inner circumferential surface female threads 63*a* are formed is fixed to the lower frame 11. A cylindrical lift ram (lifting member) 65 that includes, on its lower outer circumferential surface, male threads 65*a* that meshes with the female threads 63*a* is rotatably housed in the female thread member 63.

In FIG. 2, shown is a state where the lift ram 65 is at its uppermost position. When the lift ram 65 lifts up the lifter pipe 53 via an attachment (a die-support member) 67, an upper end surface of the die $D_2$ associated with the lifter pipe 53 is lifted up to a path line (a conveying path of the work W) PL. Note that, in FIG. 2, an opening 31*a* into which the punch P and the die D enter is formed at an associated portion with the die D on the fixed table 31.

A rotatable driven ring 69 that rotates together with the lift ram 65 is disposed at an upper end of the female thread member 63. The rotatable driven ring 69 is spline-coupled with the lift ram 65 above the male threads 65*a*. Therefore, the lift ram 65 can rotate integrally with the rotatable driven ring 69 and concurrently move vertically to the rotatable driven ring 69.

Figure 5:
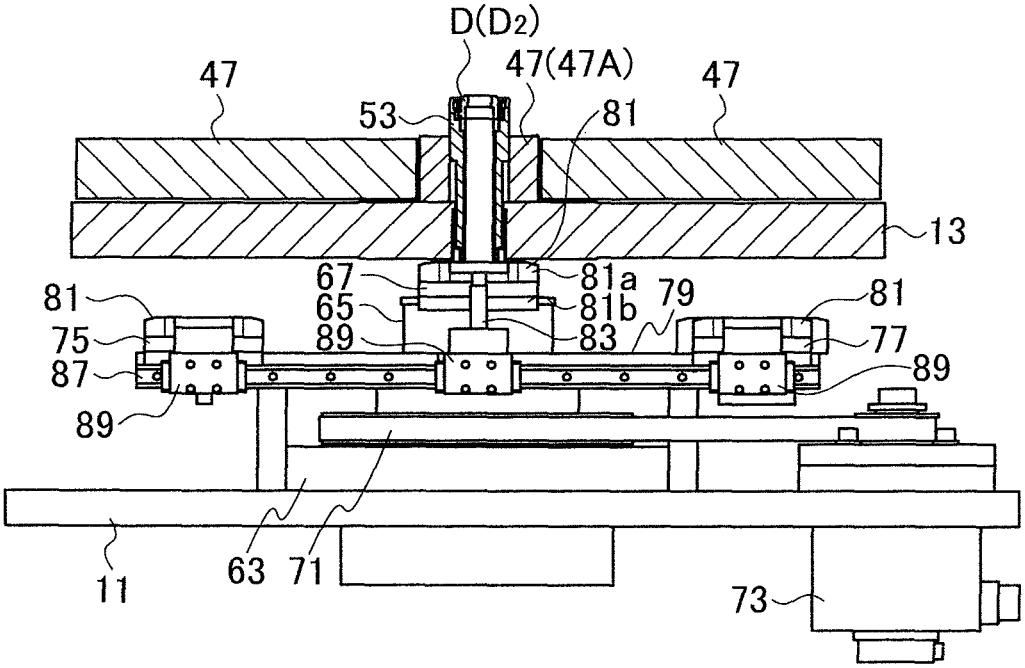
FIG. 5 It is a cross-sectional view showing a lift mechanism for a lift ram in the punch press.

Gears 69*a* are formed at an outer circumference of the rotatable driven ring 69, and the gears 69*a* mesh with a toothed belt 71. As shown in FIG. 5, the toothed belt 71 couples the rotatable driven ring 69 with an output shaft of a drive motor 73 attached to the lower frame 11 so as to interlock them.

Therefore, when the drive motor 73 is driven, the rotatable driven ring 69 is rotated via the toothed belt 71. The lift ram 65 that rotates integrally with the rotatable driven ring 69 is moved vertically by the male threads 65*a* and the female threads 63*a*.

The attachment 67 (the die-support member) is disposed between the lift ram 65 and the lower turret 13. The attachment 67 shown in FIG. 2 lifts up the die D ($D_2$) on the outer circumferential track $T_3$. An attachment 75 (see FIG. 6 and FIG. 7(*a*)) for lifting up the die D on the inner circumferential track $T_1$ and an attachment 77 (see FIG. 6 and FIG. 8(*a*)) for lifting up the die D on the center track $T_2$ are provided as other components that constitute the die-support member.

Figure 6:
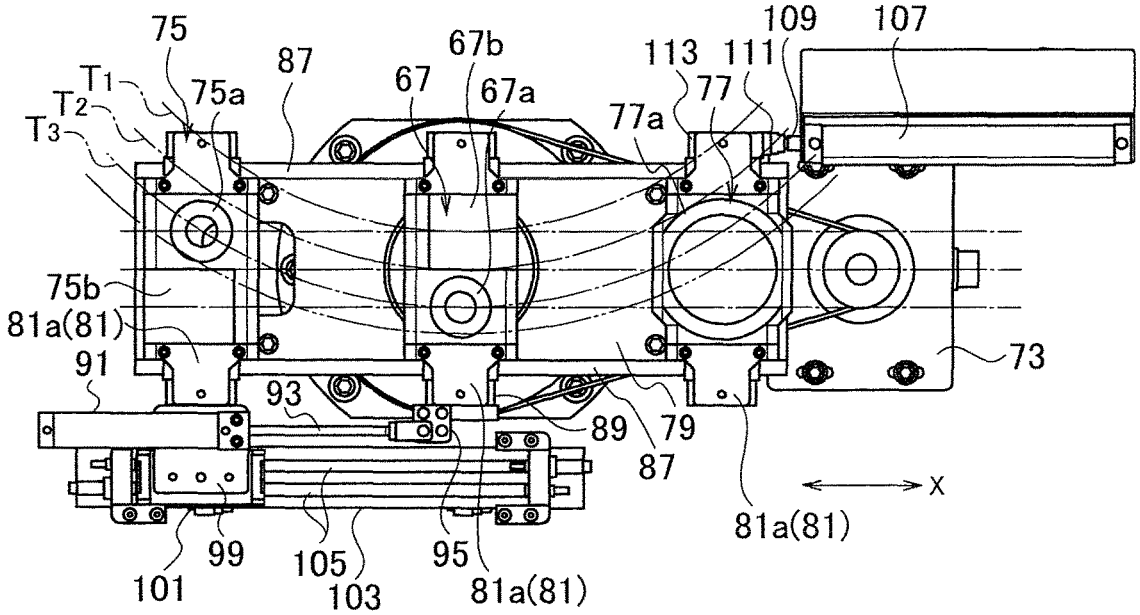
FIG. 6 It is a plan view showing attachments for the tracks and their shifting mechanisms.

These attachments 67, 75 and 77 can be moved along a lateral direction by an attachment base 79 extended in the lateral direction in FIG. 6.

As shown in FIG. 2, the attachment 67 associating with the die D ($D_2$) on the track T3 that has been set at the work position is held in a vertical direction by a pair of hooks 81 (see FIG. 2 and FIG. 6) together with the lift ram 65.

Each of both edges of the attachment 67 is held vertically by an upper member 81*a* and a lower member 81*b* of the hook 81. An inner projection 81*b*1 of the lower member 81*b* engages with a bottom surface of a ring-shaped flange 65*f* provided at an upper end of the lift ram 65, so that the lift ram 65 is held in a vertical direction together with the attachment 67.

Each of the upper member 81*a* of the hooks 81 is extended outward, and an upper end of a restriction shaft 83 for restricting rotation of the attachment 67 is coupled with an extended end of the upper member 81*a*.

Each lower portion of the restriction shafts 83 is vertically-movably inserted into a guide 85. On the other hand, a pair of guide rails 87 is extended on sides of the attachment base 79 (see FIG. 2 and FIG. 6). Then, a slider 89 is provided at each of the guide rails 87. Each of the guides 85 is fixed on a side of each of the sliders 89.

Therefore, the hooks 81 move integrally with the attachment 67. Each of the other attachments 75 and 77 also includes equivalent components to the hooks 81, the restriction shafts 83, the guides 85 and the sliders 89 explained above. Explanations for the components of the attachment 75 and 77 are omitted by adding same numerals as of equivalent components of the attachment 67 to them.

As shown in FIG. 6, the attachment 67 for the outer circumferential track $T_3$ is moved by a cylinder 91 along the attachment base 79. Namely, an end of a piston rod 93 protruded from the cylinder 91 is coupled with the slider 89 via a coupler 95.

The cylinder 91 is fixed on an attachment plate 99 as shown in FIG. 2. A rod-less cylinder 101 for moving the attachment 75 for the inner circumferential track $T_1$ is fixed on an external side of a bottom surface of the attachment plate 99. On the other hand, an internal side of the attachment plate 99 is coupled with the guide 85 of the attachment 75. Therefore, the rod-less cylinder 101 is coupled with the attachment 75 via the attachment plate 99, the guide 85, the restriction shaft 83 and the hook 81.

The rod-less cylinder 101 is moved on a base 103 provided in the lower frame 11 along guide rods 105 as shown in FIG. 2 and FIG. 6. Therefore, the attachment 75 and the attachment 67 are moved along the attachment base 79 by an operation of the rod-less cylinder 101.

On the other hand, as shown in FIG. 6, the attachment 77 for the center track $T_2$ is moved along the attachment base 79 by a cylinder 107 fixed on the lower frame 11. Namely, a coupler 111 on an end of a piston rod 109 of the cylinder 107 is coupled with the guide 85 of the attachment 77. Therefore, the piston rod 109 is coupled with the attachment 77 via the coupler 111, the guide 85, the restriction shaft 83 and the hook 81.

In FIG. 6, shown is a state where the attachment 67 for the inner circumferential track T3 is set to the work position (the piston rod 93 of the cylinder 91 is extended most). In a case where the attachment 75 for the track $T_1$ is to be set to the work position from the state shown in FIG. 6, the piston rod 93 is retracted most and the rod-less cylinder 101 is moved rightward in FIG. 6. As a result, the attachment 75 is set at the work position positioned at the center in FIG. 6, and the attachment 67 is moved to its waiting position between the attachment 75 and the attachment 77.

On the other hand, in a case where the attachment 77 for the track $T_2$ is to be set to the work position from the state shown in FIG. 6, the piston rod 93 is retracted most and the piston rod 109 is extended most by driving the cylinder 109. As a result, the attachment 77 is set at the work position positioned at the center in FIG. 6, and the attachment 67 is moved to its waiting position between the attachment 75 and the attachment 77.

As shown in FIG. 2, the attachment 67 for the track $T_3$ includes a ring-shaped protruded portion (die supporter) 67*a* for supporting the lifter pipe 53 associating with the die $D_2$ set at the work position, and a flat portion (waiting-die supporter) 67*b* for supporting the lifter pipe 51 associating with the die $D_1$ for the track $T_1$ arranged at an adjacent inside in the radial direction.

Namely, the protruded portion 67*a* supports the die $D_2$ that is to be used for punching and set at the work position in a state where it is lifted up to the path line PL of the work W, and the flat portion 67*b* concurrently supports the die $D_1$ that is to be unused for punching among the dies D ($D_1$ and $D_2$) and set at the work position at a lower level than the path line PL.

In addition, in the protruded portion 67*a*, formed is a through hole 67*a*1 that communicates a cavity 53*a* within the lifter pipe 53 located thereon with a cavity 65*b* within the lift ram 65 located thereunder. The cavity 53*a*, the cavity 65*a* and the through hole 67*a*1 constitute a hollow cavity for dropping off punched wastes made upon punching the work W.

And, this hollow cavity is suctioned from underneath of the lower frame 11 by a suction device (not shown), so that the punched wastes made upon punching are forcibly ejected outward.

Figure 7:
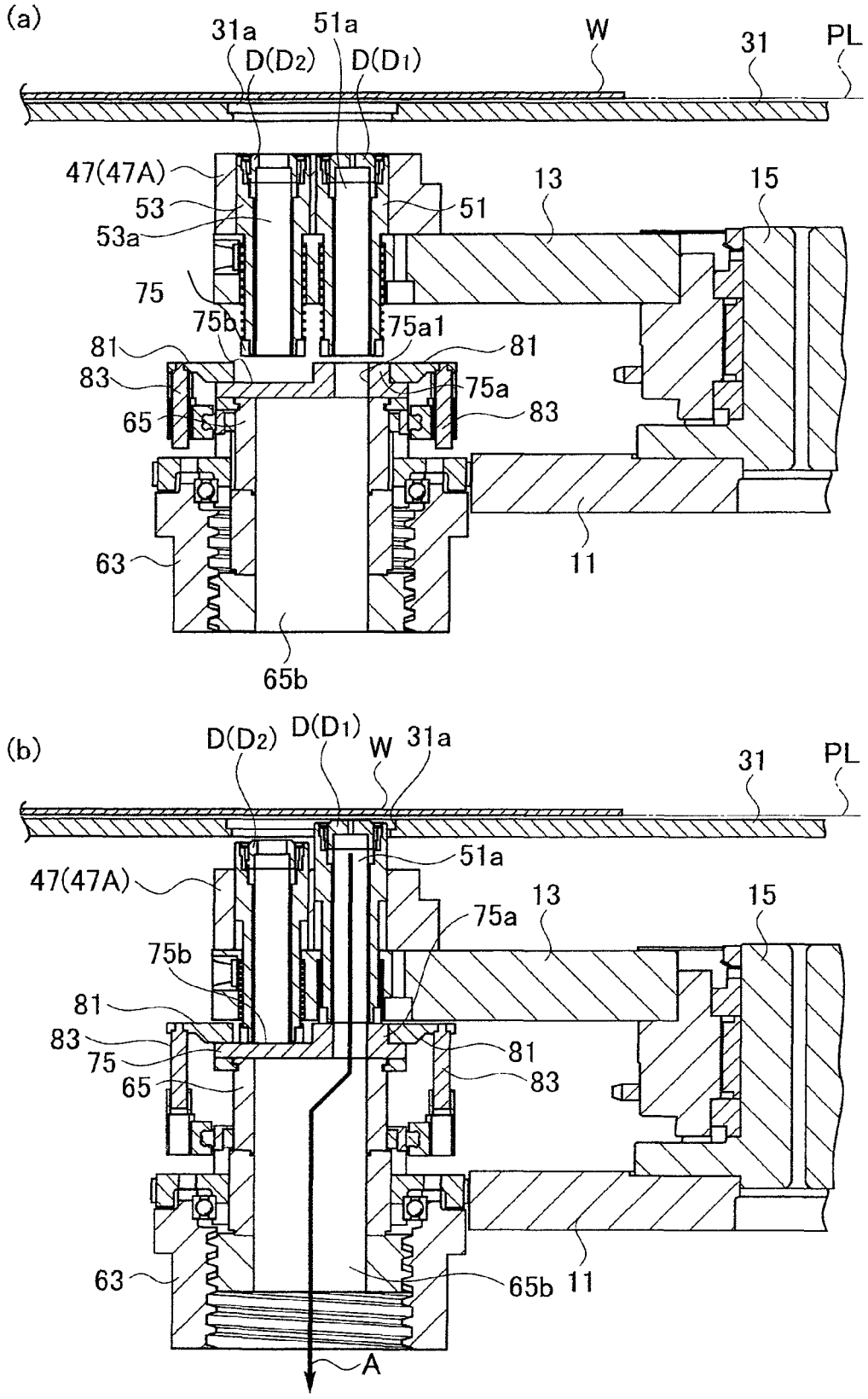
FIG. 7 They are cross-sectional views showing operations for moving the die on the inside track up to a path line in order of (*a*) to (*b*).

Similarly, as shown in FIG. 7(*a*) and FIG. 7(*b*), the attachment 75 for the track $T_1$ includes a ring-shaped protruded portion (die supporter) 75*a* for supporting the lifter pipe 51 associating with the die $D_1$ set at the work position, and a flat portion (waiting-die supporter) 75*b* for supporting the lifter pipe 53 associating with the die $D_2$ for the track $T_3$ arranged at an adjacent outside in the radial direction.

Namely, the protruded portion 75*a* supports the die $D_1$ that is to be used for punching and set at the work position in a state where it is lifted up to the path line PL of the work W, and the flat portion 75*b* concurrently supports the die $D_2$ that is to be unused for punching among the dies D ($D_1$ and $D_2$) and set to the work position at a lower level than the path line PL.

In addition, in the protruded portion 75*a*, formed is a through hole 75*a*1 that communicates a cavity 51*a* within the lifter pipe 51 located thereon with a cavity 65*b* within the lift ram 65 located thereunder. The cavity 51*a*, the cavity 65*b* and the through hole 75*a*1 constitute a hollow cavity for dropping off punched wastes made upon punching the work W.

Figure 8:
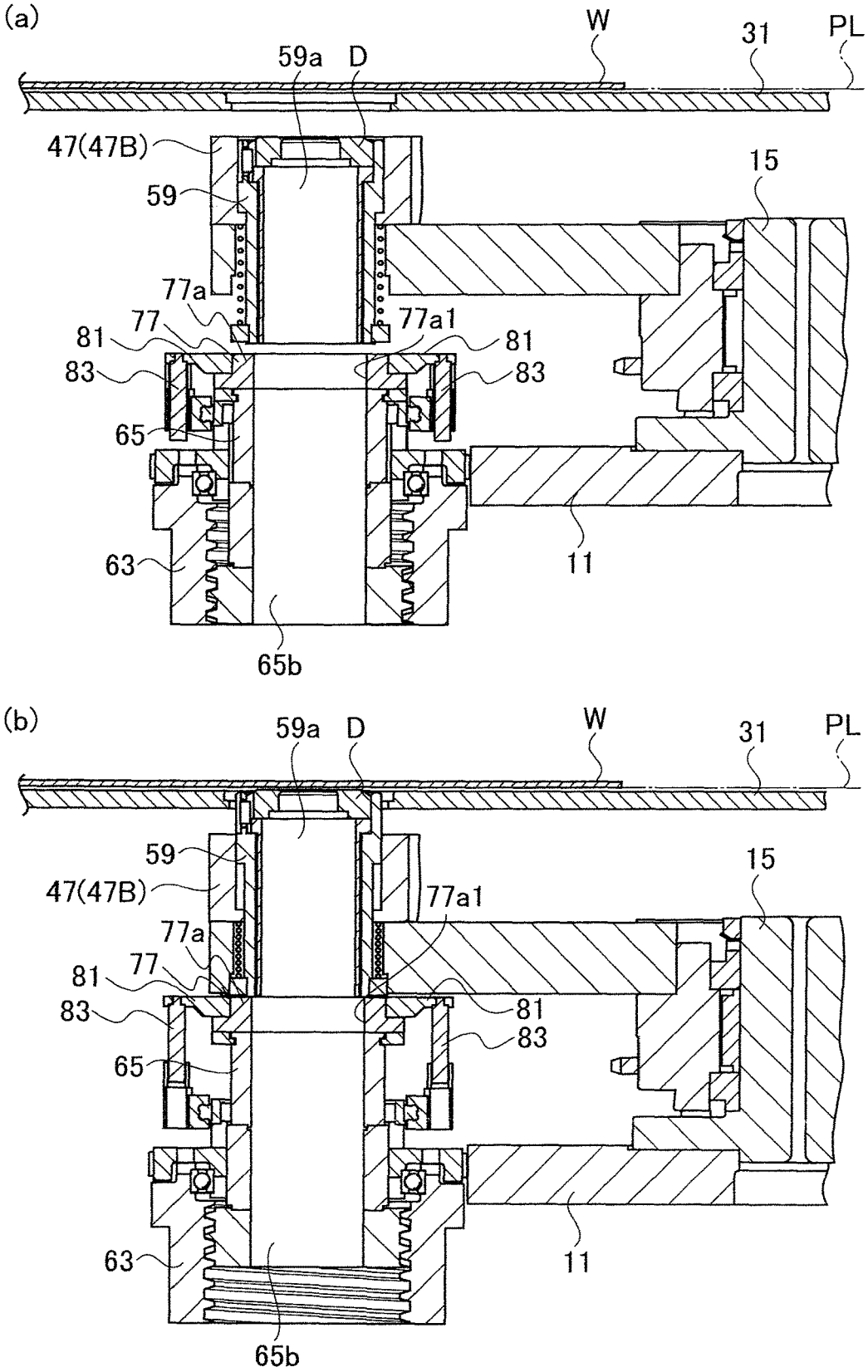
FIG. 8 They are cross-sectional views showing operations for moving the die on the center track up to the path line in order of (*a*) to (*b*).

As shown in FIG. 8(*a*) and FIG. 8(*b*), the attachment 77 for the track $T_2$ includes a ring-shaped protruded portion (die supporter) 77*a* for supporting the lifter pipe 59 associating with the die D set at the work position.

Namely, the protruded portion 77*a* supports the die D that is to be used for punching and set at the work position in a state where it is lifted up to the path line PL of the work W.

In addition, in the protruded portion 77*a*, formed is a through hole 77*a*1 that communicates a cavity 59*a* within the lifter pipe 59 located thereon with a cavity 65*b* within the lift ram 65 located thereunder. The cavity 59*a*, the cavity 65*b* and the through hole 77*a*1 constitute a hollow cavity for dropping off punched wastes made upon punching the work W.

Note that, on the center track $T_2$, there exists a die(s) D smaller than the through hole 77*a*1 of the attachment 77 for the track $T_2$. A lower end of a lifter pipe for this small-diameter die D has an inner diameter almost same as that of the through hole 77*a*1, and a portion upper from this large-diameter portion of the lifter pipe is formed as a small-diameter portion for supporting the small-diameter die D. Therefore, the lifter pipe for the small-diameter die D can be supported by the protruded portion 77*a*.

Next, operation will be explained. The upper turret 7 and the lower turret 13 are rotated adequately to set the punch P and the die D needed for punching at a position associating with the striker 23 as shown in FIG. 1. In addition, the work W is set at the work position above the lower turret 13 by the alignment unit 29.

Here, punching by uses of the die D ($D_1$) for the inner circumferential track $T_1$ will be explained as an example. Note that, in this case, the striker 23 is set by the shifting cylinder 25 so as to be aligned on the track $T_1$.

In addition, the attachment 75 for the track $T_1$ is set at the work position. As explained above, from the state shown in FIG. 6, the piston rod 93 is retracted most and the rod-less cylinder 101 is moved rightward in FIG. 6. As a result, the attachment 75 is set at the work position positioned at the center in FIG. 6, and the attachment 67 is moved to its waiting position between the attachment 75 and the attachment 77.

At this moment, the lift ram 65 is located at its lowermost position as shown in FIG. 7(*a*). The attachment 75 is also located at its lowermost position when the lift ram 65 is located at its lowermost position, and a minor gap is formed between a bottom surface of the attachment 75 and an upper surface of the lift ram 65. Therefore, the attachment 75 can be slid to an above position of the lift ram 65 located at its lowermost position shown in FIG. 7(*a*).

Note that the above-explained sliding of the attachment 75 is done synchronously with rotation and alignment of the upper turret 7 and the lower turret 11.

When the attachment 75 has been slid to the above position of the lift ram 65, the projections 81*b*1 are inserted into under sides of the flange 65*f* of the lift ram 65, so that the relative vertical movement between the lift ram 65 and the attachment is restricted. At this moment, the lift ram 65 can rotate relatively to the hooks 81 (the projections 81*b*1).

When the lift ram 65 is rotated by driving the drive motor 73 (see FIG. 5) from this state, the lift ram 65 is lifted up due to meshing between the male threads 65*a* and the female threads 63 of the female thread member 63.

The attachment 75 is also lifted up together with the hooks 81 by lift-up of the lift ram 65. At this time, the protruded portion 75*a* of the attachment 75 contacts with the lower end of the lifter pipe 51 and the lifter pipe 51 is lifted up against the elastic force of the spring 55 (see FIG. 4(*a*)), so that the die $D_1$ at the work position is entered into the opening 31*a* of the fixed table 31. As a result, the upper end surface of the die $D_1$ is lifted up to the path line PL of the work W.

On the other hand, the flat portion 75*b* of the attachment 75 contacts with the lower end of the lifter pipe 53 for the track T3 and the lifter pipe 53 is lifted against the elastic force of the spring 57 (see FIG. 4(*a*)). However, its lift-up stroke is small by a stepped amount between the upper surface of the protruded portion 75*a* and the upper surface of the flat portion 75*b*, so that the upper end surface of the die $D_2$ is located at a level slightly lower the bottom surface of the fixed table 31.

In this state, the punch P associating with the die $D_1$ is struck by the striker 23 to perform punching. Here, the punched wastes are ejected outward as shown by an arrow A in FIG. 7(*b*) through a punched waste path (the hollow cavity) formed of the cavity 51*a*, the through hole 75*a*1 and the cavity 65*b* by driving the suction device (not shown).

At this moment, an upper opening of the cavity 65*b* in the lift ram 65 is closed by a portion of the attachment 75 other than the through hole 75*a*1 (incl. the flat portion 75*b*). Therefore, the inside of the punched waste path is made almost sealed between the die $D_1$ and the suction device. As a result, the punched wastes can be ejected out efficiently, and scattering of the punched wastes and remaining of the punched wastes due to short of suction force of the suction device can be prevented.

The operation by use of the attachment 75 for the track $T_1$ is explained above as an example. Note that, when the attachment 67 for the track $T_3$ is used, the protruded portion 67*a* of the attachment 67 lifts up the lifter pipe 53 for the die $D_2$ to lift the upper end surface of the die $D_2$ up to the path line PL as shown in FIG. 2.

On the other hand, the flat portion 67*b* of the attachment 67 contacts with the lower end of the lifter pipe 51 for the die $D_1$ on the track $T_1$, so that the upper end surface of the die $D_1$ is located at a level slightly lower the bottom surface of the fixed table 31. In this state, the punch P associating with the die $D_2$ is struck by the striker 23 to perform punching.

Also in this case, the punched wastes are ejected outward through a punched waste path formed of the cavity 53*a*, the through hole 67*a*1 and the cavity 65*b* by driving the suction device (not shown).

At this moment, the upper opening of the cavity 65*b* in the lift ram 65 is closed by a portion of the attachment 67 other than the through hole 67*a*1 (incl. the flat portion 67*b*). Therefore, the inside of the punched waste path is made almost sealed between the die $D_2$ and the suction device. As a result, the punched wastes can be ejected out efficiently, and scattering of the punched wastes and remaining of the punched wastes due to short of suction force of the suction device can be prevented.

Alternatively, when the attachment 77 for the track $T_2$ is used, the protruded portion 77*a* of the attachment 77 lifts up the lifter pipe 59 to lift the upper end surface of the die D up to the path line PL as shown in FIG. 8(*a*) and FIG. 8(*b*).

In this state, the punch P associating with the die D is struck by the striker 23 to perform punching. Also in this case, the punched wastes are ejected outward through a punched waste path formed of the cavity 59*a*, the through hole 77*a*1 and the cavity 65*b* by driving the suction device (not shown).

At this moment, the inside of the punched waste path is made almost sealed between the die D and the suction device, so that the punched wastes can be ejected out efficiently and scattering of the punched wastes and remaining of the punched wastes due to short of suction force of the suction device can be prevented.

In the present embodiment, the attachments 67, 75 and 77 (the die-support members) are provided with the selectable protruded portions (the die supporters) 67*a*, 75*a* and 77*a* for lifting the die D set at the work position up to the path line PL of the work W.

According to the present embodiment, when the work W is moved along the path line PL to be set at the work position above the lower turret 13, the die D is made waited at a lower level than the path line PL and the fixed table 31 as shown in FIG. 7(*a*) and FIG. 8(*a*). Therefore, it can be prevented that the bottom surface of the work W moving along the path line PL is damaged due to contacts with the upper end surface of the die D.

In addition, only a die D to be used for punching is lifted up to the path line PL when punching. Therefore, punching can be performed by the requisite die D while preventing damages on the work W as explained above.

In addition, in the present embodiment, the three attachments 75, 77 and 67 are provided in association with the dies D on the three tracks T1, T2 and T3 provided concentrically so as to be able to move independently between the work position and the waiting position(s) distanced from the work position. Therefore, the plural dies D provided not only along the circumferential direction but also provided along the radial direction can be utilized, so that punching can be performed while preventing damages on the work during upon conveying.

At that time, the attachment 75, 77 or 67 can be easily set at the work position by sliding the attachment 75, 77 or 67 on the slide base 9.

In addition, the attachment 67 (the die-support member) includes the protruded portion (the die supporter) 67*a* and the flat portion 67*b* along the radial direction of the lower turret 13, and can move along a tangential direction of the lower turret 13 located at the work position. Also the attachment 75 (the die-support member) includes the protruded portion (the die supporter) 75*a* and the flat portion 75*b* along the radial direction of the lower turret 13, and can move along the tangential direction of the lower turret 13 located at the work position.

Hence, the die to be used for punching can be associated with the protruded portion by moving, along the tangential direction, the attachment associating with the die D to be used for punching among the plural dies D provided along the radial direction of the lower turret 13. Therefore, the die D to be used for punching can be lifted up to the path line PL and also the die D to be unused for punching can be located at a lower level than the path line by the flat portion.

In addition, in the present embodiment, the lift ram 65 and the protruded portions 65*a*, 75*a* and 77*a* of the attachments 67, 75 and 77 include the cavity 65*b* and the through holes 67*a*1, 75*a*1 and 77*a*1 that become the hollow cavity for dropping off the punched wastes. Therefore, the punched wastes made upon punching drop off through the hollow cavity and then can be ejected outward.

[Second Embodiment]

A turret punch press according to a second embodiment will be explained with reference to FIG. 9 to FIG. 12. In the turret punch press according to the present embodiment, a die-support member that includes a die supporter 117 and a flat portion (a waiting-die supporter) 119 is provided integrally at an upper portion of a cylindrical lift ram (lifter) 115. When an index device 125 on whose outer circumference a gear 123 is formed is rotated by a drive motor 121 arranged on a side of the lift ram 115, the lift ram 115 is rotated together with the index device 125.

In addition, the lift ram 115 is moved between its upper position (FIG. 11) and its lower position (FIG. 12) by plural vertical cylinders 127 arranged around a lower portion of the rift ram 115. Each of the vertical cylinders 127 has a piston rod 129 that can be projected downward. Each end (lower end) of the piston rods 129 is coupled with a ring-shaped base 131 fixed to a circumferential lower end of the lift ram 115. Therefore, the piston rods 129 are projected downward from a state shown in FIG. 11, so that the lift ram 115 is moved downward together with the base 131 as shown in FIG. 12.

Figure 9:
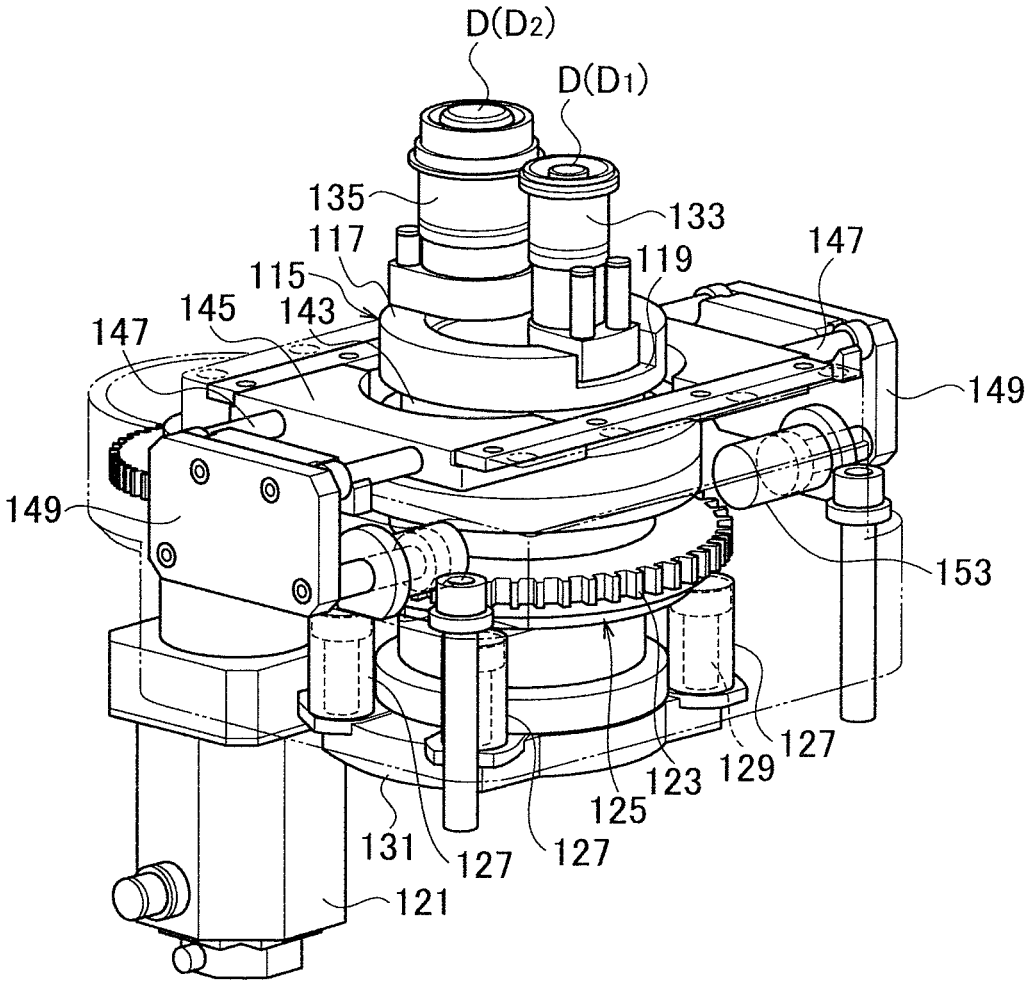
FIG. 9 It is a perspective view showing dies on the inside and outside tracks in a punch press according to a second embodiment.
Figure 10:
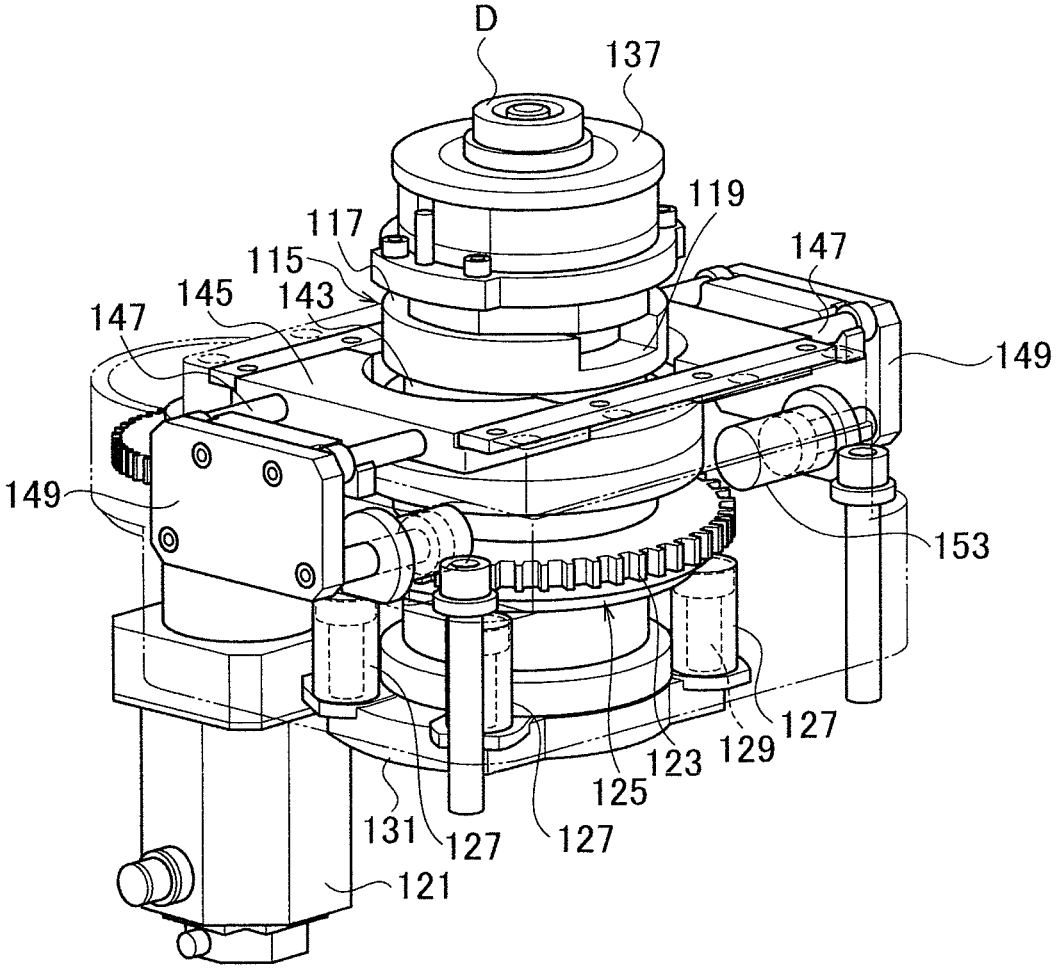
FIG. 10 It is a perspective view showing a die on the center track in the punch press.

In FIG. 9, shown are the die $D_1$ for the inner circumferential track $T_1$ and the die $D_2$ for the outer circumferential track $T_3$, similarly to the first embodiment. In FIG. 10, shown is the die D for the center track $T_2$.

Namely, in FIG. 9, lifter pipes 133 and 135 to whose upper portions the two dies ($D_1$ and $D_2$) provided along a radial direction are attached, respectively, are disposed above the lift ram 115. In FIG. 10, a lifter pipe 137 to whose upper potion the die D is attached is disposed. Each of these lifter pipes 133, 135 and 137 is biased downward by a spring, and can move vertically to the die holder attached to the lower turret so as to be moved vertically due to a vertical movement of the lift ram 115.

The two lifter pipes 133 and 135 shown in FIG. 9 are disposed on an upper surface of the ring-shaped die-support member at the upper potion of the lift ram 115, and located at positions distanced by 180° along a circumferential direction with each other. On the other hand, the one lifter pipe 137 shown in FIG. 10 is disposed on an upper surface of the die-support member so as to make its center axis coincident with the a center axis of the lift ram 115 as shown by a cross sectional view shown in FIG. 11.

In FIG. 9, the lifter pipe 135 for the die $D_2$ on the track $T_3$ is disposed on the die supporter 117 of the die-support member. On the other hand, the lifter pipe 133 for the die $D_1$ on the track $T_1$ is disposed in the flat portion 119 that is formed by cutting off the die supporter 117.

Namely, when the lift ram 115 is lifted up, the die $D_2$ on the lifter pipe 135 reaches up to the path line PL of the work by the die-support member 117, and the die $D_1$ is located at a lower level than the path line Pl by the flat portion 119

A groove 143 is formed on an outer circumferential surface of a lower portion of the rift ram 115 than the die-support member. Blocks 145 can move between its forward position (FIG. 11) and its backward position (FIG. 12) in relation to the groove 143. The blocks 145 are coupled with upper portions of coupling plates 149 via rods 147, respectively. The blocks 145 are moved by stroking piston rods 151 by cylinders 153.

Next, operation will be explained. As shown in FIG. 12, the lifter pipe 137 (also the lifter pipes 133 and 135 in FIG. 9 are similar) is biased downward by the spring in a state where the lift ram 115 is took down, and the upper end surfaces of the dies D ($D_1$ and $D_2$) are locates at a lower level than the path line PL. In this state, the work W is set at the work position above the lower turret in the same manner as the first embodiment.

In a case where the die D to be used for punching is the die $D_2$ on the track $T_3$, the lower turret is set at the work position and the dies $D_1$ and $D_2$ are located above the lift ram 115 in the state where the lift ram 115 is moved down. Then, the lift ram 115 is rotated via the index device 125 due to driving the drive motor 121, so that the flat portion 119 is set at a position associating with the track $T_1$ as shown in FIG. 9.

Subsequently, when the lift ram 115 is lifted up by driving the vertical cylinder 127, the lifter pipe 133 for the die $D_1$ to be unused for punching enters into the flat portion 119 and the lifter pipe 135 for the die $D_2$ to be used for punching contacts with the die supporter 117, as shown in FIG. 9. As a result, only the die $D_2$ on the lifter pipe 135 is lifted up to the path line PL. Note that the blocks 145 are set backward while the lift ram 115 is lifted up (see FIG. 12).

Figure 11:
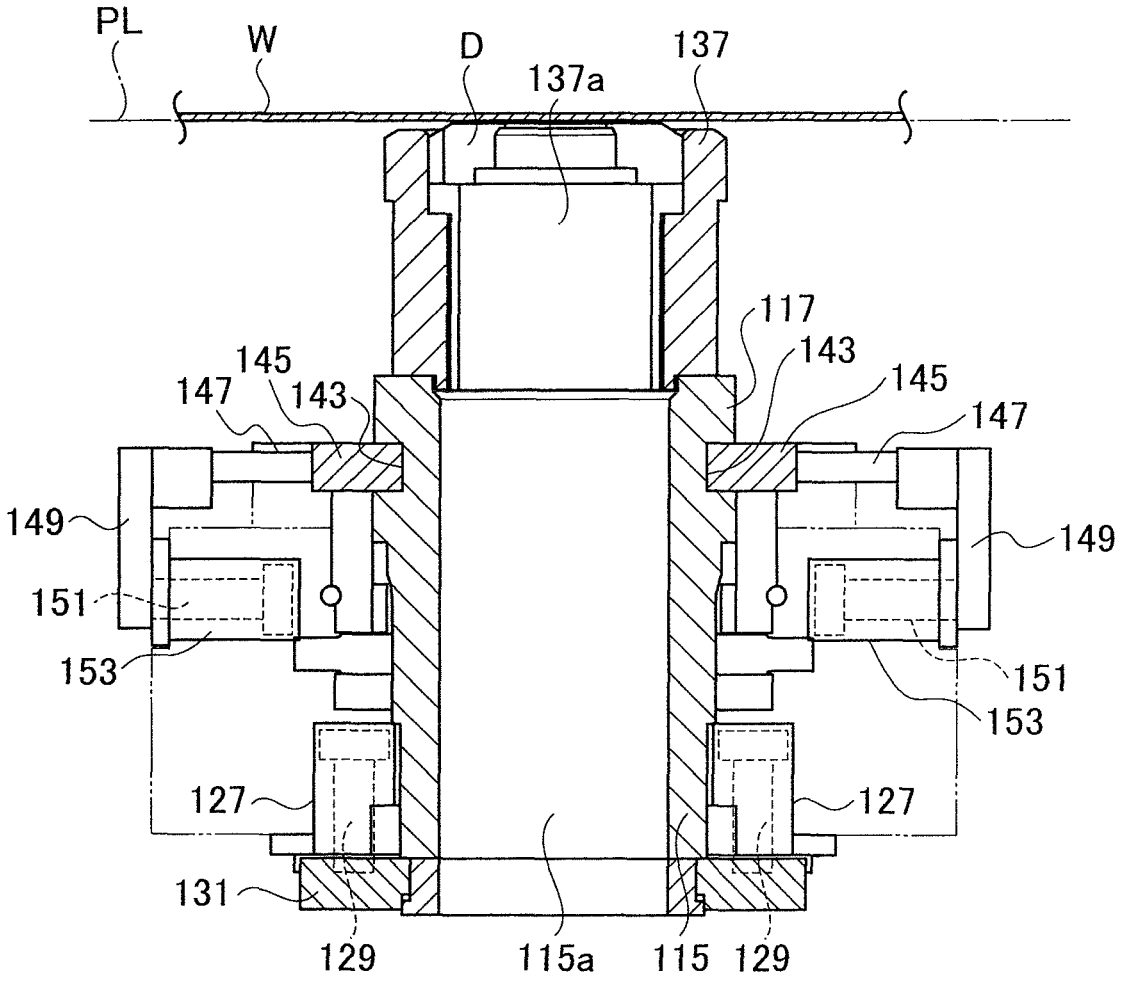
FIG. 11 It is a cross-sectional view showing the die on the center track (when a lift ram is located upward).
Figure 12:
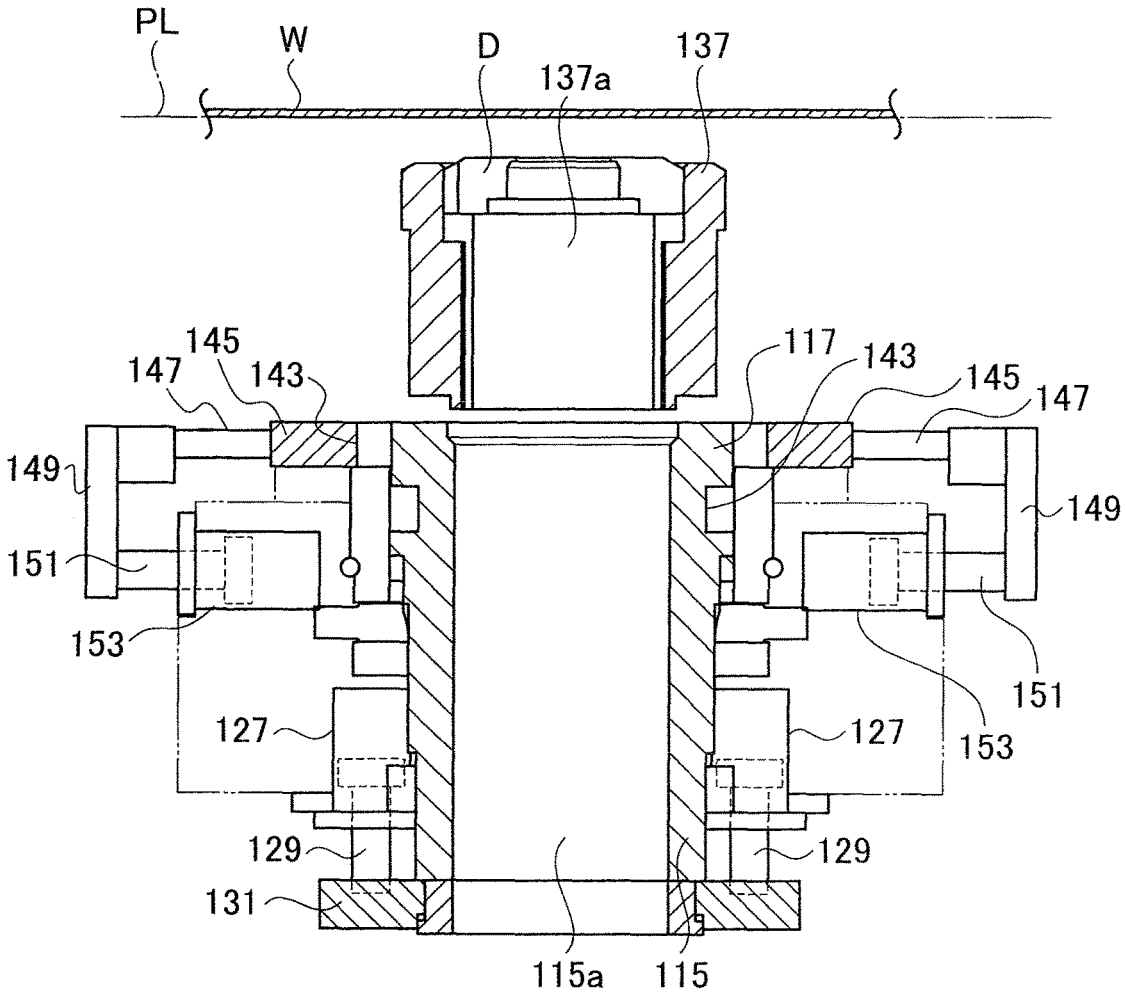
FIG. 12 It is a cross-sectional view showing the die on the center track (when the lift ram is located downward).

After the lift ram 115 is lifted up, the blocks 145 are moved forward and entered into the groove 143 on the lift ram 115 to restrict a vertical movement of the lift ram 115 (see FIG. 11). In this state, the punch P associating with the die $D_2$ is struck by the striker 23 to perform punching.

In this case, punched wastes of the work W are ejected outward through a punched waste path (a hollow cavity) formed of a cavity in the lifter pipe 135 and a cavity 115*a* in the lift ram 115.

On the other hand, in a case where the die D to be used for punching is the die $D_1$ on the track $T_1$, the flat portion 119 is set at a position associating with the track $T_3$ in the state where the lift ram 115 is moved down, and operations same as the above operations are done. Namely, in this case, when the lift ram 115 is lifted up, the lifter pipe 135 for the die $D_2$ to be unused for punching enters into the flat portion 119 and the lifter pipe 133 for the die $D_1$ to be used for punching contacts with the die supporter 117, contrary to the state shown in FIG. 9. As a result, only the die $D_1$ on the lifter pipe 133 is lifted up to the path line PL.

Subsequently, the blocks 145 are moved forward and entered into the groove 143 on the lift ram 115 to restrict a vertical movement of the lift ram 115 (see FIG. 11 and FIG. 12). In this state, the punch P associating with the die $D_1$ is struck by the striker 23 to perform punching. In this case, punched wastes of the work W are ejected outward through a punched waste path (a hollow cavity) formed of a cavity in the lifter pipe 133 and the cavity 115*a* in the lift ram 115.

In addition, in a case where the die D to be used for punching is the die D on the track $T_2$, the lift ram 115 is lifted up from a state shown in FIG. 12, and the lift ram 115 contacts with the lifter pipe 137. As a result, the die D on the lifter pipe 137 is lifted up to the path line PL. Then, the blocks 145 are moved forward and entered into the groove 143 on the lift ram 115 to restrict a vertical movement of the lift ram 115 as shown in FIG. 11. In this state, the punch P associating with the die D is struck by the striker 23 to perform punching.

In this case, punched wastes of the work W are ejected outward through a punched waste path (a hollow cavity) formed of a cavity 137*a* in the lifter pipe 137 and the cavity 115*a* in the lift ram 115.

An inner diameter of the lifter pipe 137 is almost equivalent to an inner diameter of the lift ram 115, so that the inside of the punched waste path formed of the cavities 137*a* and 115*a* is made almost sealed between the die D and the suction device. As a result, the punched wastes can be ejected out efficiently, and scattering of the punched wastes and remaining of the punched wastes due to short of suction force of the suction device can be prevented.

According to the present embodiment, when the work W is moved along the path line PL to be set at the work position, the dies D ($D_1$ and $D_2$) are made waited at a lower level than the path line PL. Therefore, it can be prevented that the bottom surface of the work W moving along the path line PL is damaged due to contacts with the upper end surface of the dies D ($D_1$ and $D_2$)

In addition, in the present embodiment, the die-support member is integrated with the upper portion of the rift ram (lifter) 115 and provided rotatably together with the lift ram 115. Further, the die supporter 117 and the flat portion 119 on the die-support member are disposed along a rotational direction of the die-support member.

Therefore, damages of the bottom surface of the work W due to contacts with the upper end surface(s) of the die(s) can be prevented by a simpler configuration. In addition, only the requisite die D is lifted up to the path line PL. Therefore, punching can be performed by the requisite die D while preventing damages on the work W as explained above.

[Lift Restrictor of Die D]

Next, a sliding stopper (a lift restrictor) 115 in the turret punch press will be explained with reference to FIG. 13 to FIG. 16. The sliding stopper 155 is provided also in the above-explained first and second embodiments. In addition, it is also provided in after-explained third to sixth embodiments. By utilizing the sliding stopper 155, it can be confirmed that the die(s) ($D_1$ and $D_2$) that was lifted up to the path line PL (FIG. 7(*b*)) has been reset to its waiting position (FIG. 7 (*a*)) after completion of punching.

The sliding stopper 155 is slidably provided on the die holder 47 (47A) at a side edge of the die(s) D along the radial direction of the lower turret 13. The sliding stopper 155 is covered by a stopper holder 157, so that its vertical displacement is restricted. Namely, the sliding stopper 155 slides along the radial direction of the lower turret 13 within a gap between an upper surface of the die holder 47 (47A) and the stopper holder 157.

Figure 13:
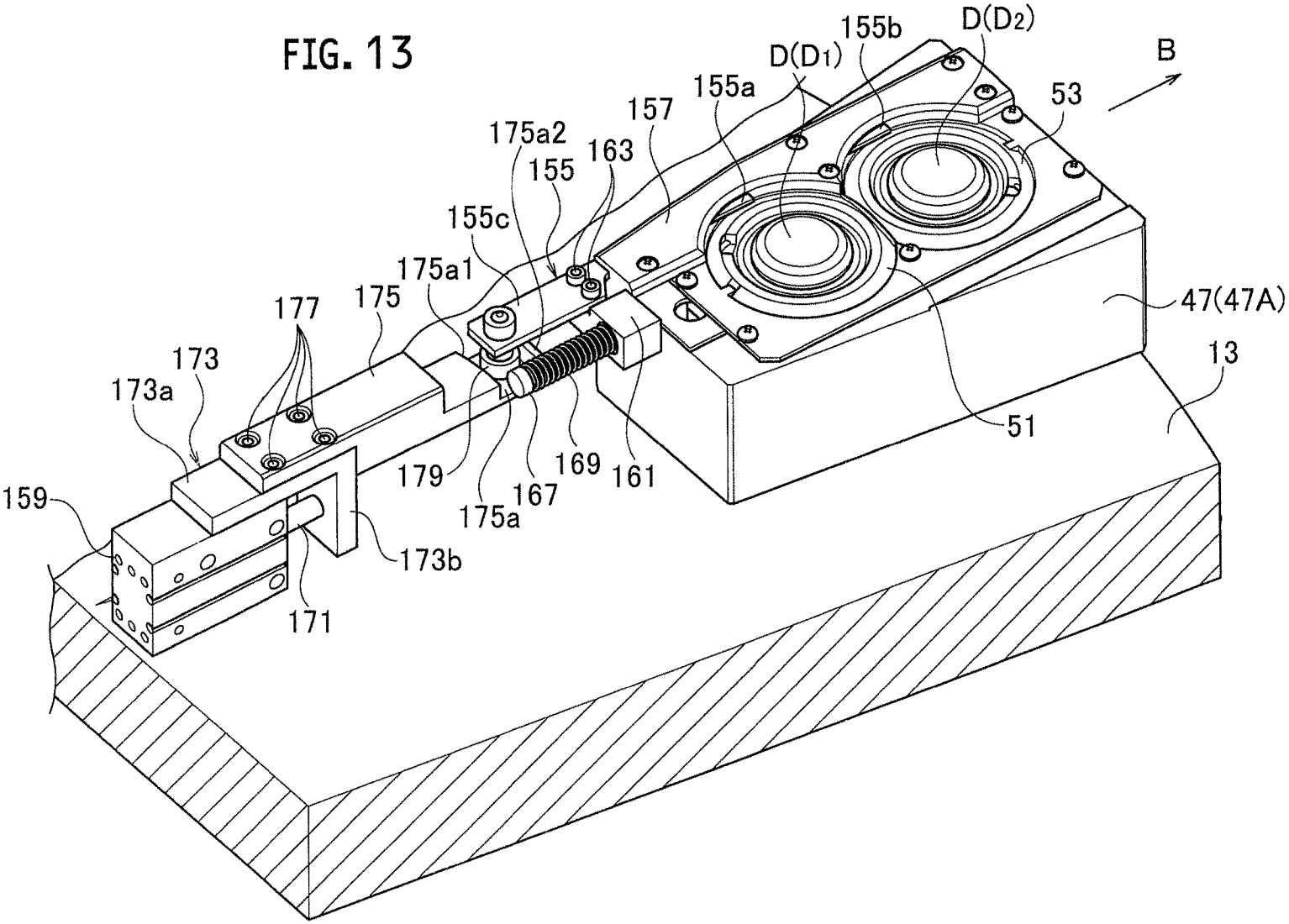
FIG. 13 It is a perspective view showing a lift restrictor (a slide stopper) (during locking).
Figure 14:
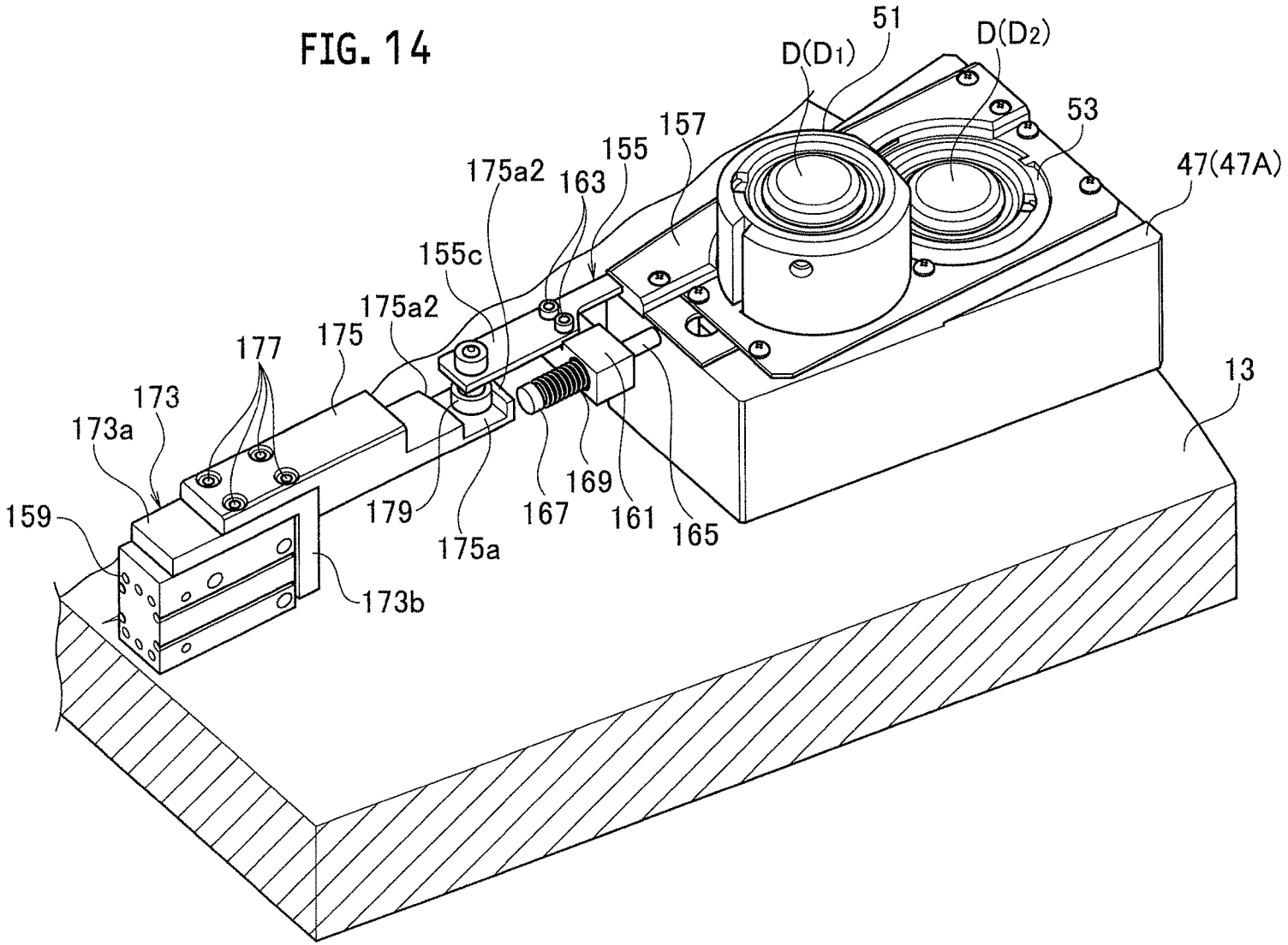
FIG. 14 It is a perspective view showing the lift restrictor (the slide stopper) (during unlocking).
Figure 15:
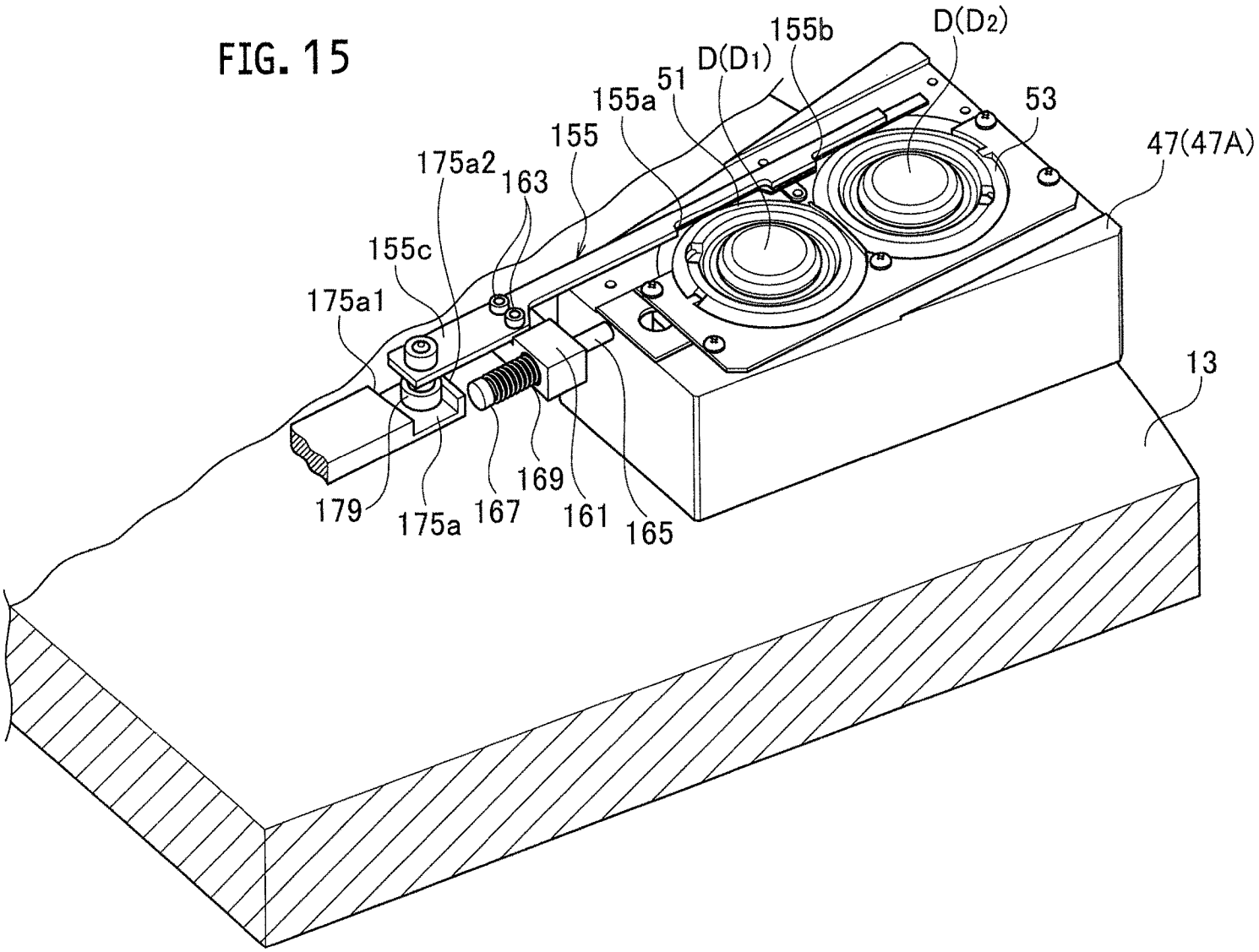
FIG. 15 It is a perspective view corresponding to FIG. 14 with the slide stopper omitted.

Stopper tabs 155*a* and 155*b* are projected from a side edge of the sliding stopper 155 towards the dies ($D_1$ and $D_2$), respectively. FIG. 13 shows a locked state where the sliding stopper 155 is slid outward (in a direction indicated by an arrow B in FIG. 13) along the radial direction of the lower turret 13 and the stopper tabs 155*a* and 155*b* are engaged with upper circumferential edges of the lifter pipes 51 and 53 for the dies $D_1$ and D2, respectively On the other hand, FIG. 14 and FIG. 15 show an unlocked state where the sliding stopper 155 is slid inward along the radial direction of the lower turret 13 by driving the stopper drive cylinder (restriction canceller) 159 and restriction of the lifter pipes 51 and 53 by the stopper tabs 155*a* and 155*b* is cancelled. Note that the stopper drive cylinder 159 in the present embodiment is an air cylinder. Therefore, in the state shown in FIG. 14 and FIG. 15, the lifter pipes 51 and 53 can be lifted up when lifting up the dies $D_1$ and $D_2$ for punching of the work W.

Namely, the sliding stopper (lift restrictor) 155 cab be slide between its lift restricting position where the stopper tabs 155*a* and 155*b* contact with the upper surfaces of the dies $D_1$ and $D_2$ and its lift allowing position that deviates from the lift restricting position.

Note that, FIG. 15 shows a state where the stopper holder 157 that is shown in FIG. 13 and FIG. 14 is not shown. In addition, FIG. 15 shows a state where the sliding stopper 155 is located at the lift allowing position but the die $D_1$ or $D_2$ is not lifted up.

The sliding stopper 155 includes an extended base 155*c* extending inward along the radial direction of the lower turret 13. A movable block 161 is fixed on a bottom surface of the sliding stopper 155 by screws 163. The movable block 161 is projected from the extended base 155*c* in a direction perpendicular to the radial direction of the lower turret 13 and coupled with a guide pin 165 (see FIG. 14 and FIG. 15), so that it can move in an axial direction of the guide pin 165.

The guide pin 165 is extended inward along the radial direction from an inner side surface of the die holder 47A in the radial direction. A spring seat 167 is formed at an end of the guide pin 165. A lock spring (elastic member) 169 is provided between the spring seat 167 and the movable block 161.

In FIG. 13, the movable block 161 contacts with the die holder 47A by being pushed by the lock spring 169. Along with this, the sliding stopper 155 is slid to its identical direction and located at the lift restricting position, so that the dies $D_1$ and $D_2$ are in the locked state. Contrary to this, in FIG. 14 and FIG. 15, the sliding stopper 155 is slid against the lock spring 169 by driving of the stopper drive cylinder 159, so that the dies $D_1$ and $D_2$ are in the unlocked state.

Note that, although the sliding stopper 155, the movable block 161, guide pin 165, the lock spring 169 and so on shown in FIG. 13 to FIG. 15 are not shown in FIG. 2 and FIG. 3, they are provided in all of the die holders 47.

Figure 16:
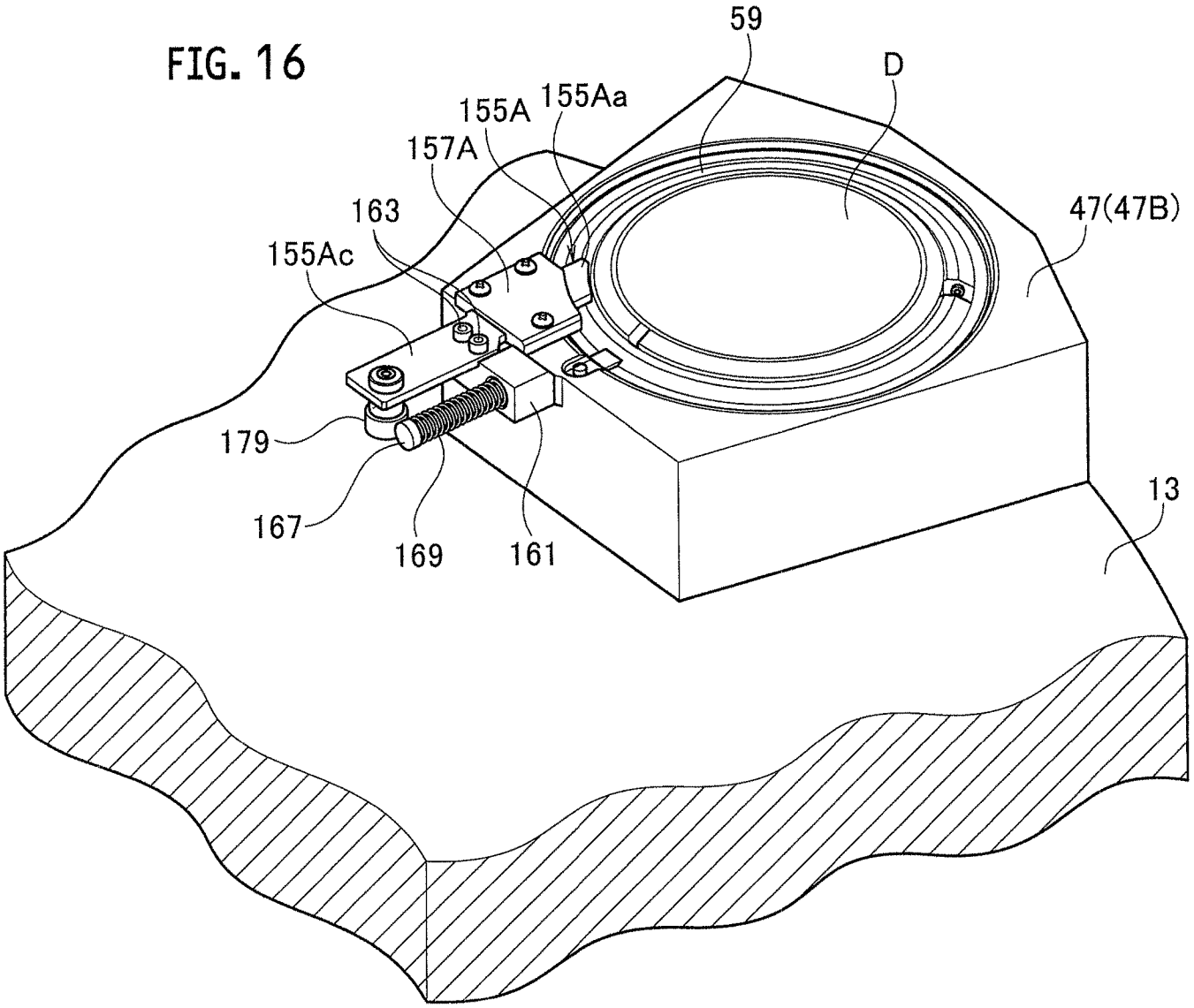
FIG. 16 It is a perspective view in a case of a large-diameter die.

However, since the one large-diameter die D is provided in the die holder 47 (47B) on the track $T_2$, a short sliding stopper 155A shown in FIG. 16 is used instead of the long sliding stopper 155 shown in FIG. 13 to FIG. 15. The short sliding stopper 155A includes an extended base 155Ac extending inward along the radial direction of the lower turret 13 and a stopper tab 155Aa provided at an end thereof.

In addition, a short stopper holder stopper 157A shown in FIG. 16 is used instead of the long stopper holder 157 shown in FIG. 13 and FIG. 14. The stopper tab 155Aa extended out from the stopper holder 157A engages with an upper circumferential edge of the lifter pipe 59 for the die D.

The stopper drive cylinder 159 for driving the sliding stopper 155 (the sliding stopper 155A) from the locked state shown in FIG. 13 (FIG. 16) to the unlocked state shown in FIG. 14 is attached to a bottom surface of the fixed table 31 at the work position (on a right side of the die holder 47 shown in FIG. 2). Namely, the stopper drive cylinder 159 is separated from the lower turret 13.

Therefore, the single stopper drive cylinder 159 is provided so as to be shared by all of the die holders 47 and can unlock the sliding stopper 155 (155A) on the die holder 47 located at the work position.

The stopper drive cylinder 159 includes a piston rod 171 projected toward the die holder 47 and a sliding bracket 173 as shown in FIG. 13 and FIG. 14. The sliding bracket 173 includes a slider 173*a* capable of sliding along a projecting direction of the piston rod 171 and a tab 173*b* extended downward from an end of the slider 173*a*. An end of the piston rod 171 is coupled with the tab 173*b*.

A coupling plate 175 is fixed on an upper surface of the slider 173*a* by screws 177. A depression 175*a* is formed at an end of the coupling plate 175. Sidewalls 175*a*1 and 175*a*2 are provided on both sides of the depression 175*a* in the radial direction of the lower turret 13, respectively. Both sides of the depression 175 in a circumferential direction perpendicular to the radial direction are opened. On the other hand, a roller 179 that enters into the depression 175*a* is provided from a bottom surface of the extended base 155*c* of the sliding stopper 155.

Namely, when the piston rod 171 is moved backward by driving the stopper drive cylinder 159 in the locked position shown in FIG. 13, the sidewall 175*a*2 of the depression 175*a* engages with the roller 179 and thereby the sliding stopper 155 is moved inward. As a result, the unlocked state shown in FIG. 15 is formed. The die D ($D_1$) to be used for punching is lifted up in the unlocked state together with the lifter pipe 51, so that the state shown in FIG. 14 is formed.

In addition, the die D ($D_1$) is took down together with the lifter pipe 51 from the state shown in FIG. 14 and then the piston rod 171 is moved forward by driving the stopper drive cylinder 159, so that the stopper tabs 155*a* and 155*b* of the sliding stopper 155 contact with the dies D ($D_1$ and $D_2$) to form the locked state (see FIG. 13).

The movable block 161 is contacted with the die holder 47 (47A) by the lock spring 169 under the locked state, so that the locked state of the sliding stopper 155 is kept.

When the lower turret 13 is rotated from the state shown in FIG. 13, the roller 179 moves outward from an opened side of the depression 175*a*. On the other hand, when the die holder 47 (47A) is moved to the work position, the roller 179 moves into an inside of the depression 175*a* from another opened side of the depression 175*a*.

Next, operation will be explained. As explained in the first embodiment, the lift ram 65 shown in FIG. 2 is took down when the lower turret 13 is rotated, and the die(s) D is located at a lower level than the fixed table 31. Then, the die holder 47 (47A) is set at the work position by rotating the lower turret 13, so that the roller 179 enters into the inside of the depression 175*a* as shown in FIG. 13.

Subsequently, the piston rod 171 is moved backward by driving the stopper drive cylinder 159, so that the sliding stopper 155 is pulled inward as shown in FIG. 15 and then restriction of the lifter pipes 51 and 53 by the stopper tabs 155*a* and 155*b* is released to form the unlock state.

Further, when the lift ram 65 is lifted up as shown in FIG. 2, the lifter pipe 53 is lifted up by the attachment 67 and the upper end surface of the die $D_2$ on the lifter pipe 53 is lifted up to the path line PL.

In this state, the striker 23 is moved so as to be located above the die $D_2$ and the punch P associating with the die $D_2$ is struck by the striker 23 to perform punching.

After completion of punching by the die $D_2$, the lift ram 65 is moved downward and the lifter pipes 51 and 53 are moved downward together with the dies $D_1$ and $D_2$, so that the upper surfaces of the dies $D_1$ and $D_2$ is made flat to the upper surface of the die holder 47A. Then, the stopper drive cylinder 159 is driven forward, so that the lifter pipes 51 and 53 are made restricted by the stopper tabs 155*a* and 155*b* to form the locked state as shown in FIG. 13.

Since the lock spring 169 biases the sliding stopper 155 in the direction D in FIG. 13 via the movable block 161, the locked state is kept.

The locked state of the sliding stopper 155 can be detected through an operated position of the stopper drive cylinder 159. Alternatively, it may be detected by additionally providing a sensor for directly detecting the sliding stopper 155. According to this, it can be confirmed that the stopper tabs 155*a* and 155*b* engage with the lifter pipes 51 and 53 and the lifter pipes 51 and 53 are located at their adequate waiting positions in the die holder 47A.

Therefore, contacts between the die(s) (the lifter pipe(s)) and the fixed table 31 due to the rotation of the lower turret 13 can be prevented, so that damages of the fixed table 31 and the lifter pipe(s) can be obviated.

[Exchange of Die(s) D]

Next, an exchange operation of die(s) will be explained. This exchange operation is done in the above-explained first to third embodiments and in after-explained fourth to sixth embodiments. As explained above, the lifter pipe 51,53 and 59 are provided with the through holes 51*a*, 53*a* and 59*a* shown in FIG. 4(*a*) and FIG. 4 (*b*), respectively. An ejector pipe(s) 181, 183 and 185 is disposed in the through hole(s) 51*a*, 53*a* and 59*a* below the die D ($D_1$, $D_2$ and D).

The ejector pipe 181, 183 or 185 is pressed upward by a pressing member (not shown) from beneath at an exchange position that locates at a position rotationally shifted from the work position by a predetermined rotational angle, so that the die D ($D_1$, $D_2$ or D) is upwardly protruded out from the lifter pipe 51*a*, 53*a* or 59*a*. The die D ($D_1$, $D_2$ or D) can be removed away by a gripper of an automatic tool changer (ATC: not shown) in a state where it is upwardly protruded.

Note that an outer diameter of the lower turret 13 is made larger than an outer diameter of the upper turret 7 and rotational centers of the turrets 13 and 7 are made eccentric to each other s that the gripper can grip the die D. According to this, the die exchange position of the lower turret 13 can be shifted outward in a plan view of the upper turret 7 (Japanese Patent Application Laid-Open No. 2000-140957).

The ejector pipe 181, 183 or 185 includes a cylindrical portion 181*a*, 183*a* or 185*a* and a flange 181*b*, 183*b* or 185*b* formed at an upper end of the cylindrical portion 181*a*, 183*a* or 185*a*. An outer diameter of the flange 181*b*, 183*b* or 185*b* is made almost equivalent-to or slightly smaller-than an outer diameter of the die D ($D_1$, $D_2$ or D).

A die housing hole 51*b*, 53*b* or 59*b* is formed at an upper end of the through hole 51*a*, 53*a* or 59*a* of the lifter pipe 51, 53 or 59. The flange 181*b*, 183*b* or 185*b* is disposed below the die housing hole 51*b*, 53*b* or 59*b*, and the die D ($D_1$, $D_2$ or D) is disposed in the die housing hole 51*b*, 53*b* or 59*b* above the flange 181*b*, 183*b* or 185*b*. In this state, the upper surface of the die D ($D_1$, $D_2$ or D) is set at a level almost equivalent-to or slightly higher-than an upper end edge of the lifter pipe 51, 53 or 59.

Namely, the flange 181*b*, 183*b* or 185*b* is set on a stepped portion 51*c*, 53*c* and 59*c* at an lower end of the die housing hole 51*b*, 53*b* or 59*b*, and the die $D_1$, $D_2$ or D is laid on the flange 181*b*, 183*b* or 185*b*.

Note that rotation of the die D ($D_1$, $D_2$ or D) in the die housing hole 51*b*, 53*b* or 59*b* is restricted.

When the ejector pipe 181,183 or 185 is lifted up relatively to the lifter pipe 51, 53 or 59 from a state shown in FIG. 4(*a*) or FIG. 4(*b*), the flange 181*b*, 183*b* or 185*b* lifts up the die $D_1$, $D_2$ or D. As a result, the $D_1$, $D_2$ or D is upwardly protruded out from the lifter pipe 51*a*, 53*a* or 59*a*. The die $D_1$, $D_2$ or D can be removed away by the gripper of the automatic tool changer in the protruded state.

Note that, although the lifter pipe 53 or 59 shown in FIG. 4(*a*) or FIG. 4(*b*) is upwardly protruded out from the die holder 47A or 47B, this protruded state is a state where the die $D_2$ or D on the lifter pipes 53 or 59 is used in punching. The state shown in FIG. 4(*a*) or FIG. 4(*b*) is not a state for exchanging the die $D_2$ or D. In addition, the ejector pipe(s) is provided for the dies D other than the above-mentioned dies $D_1$, $D_2$ and D.

Here, as explained with reference to FIG. 13 to FIG. 15, the vertical movement of the lifter pipe 51, 53 or 59 is restricted by the sliding stopper 155 (155A) in a state where the die holder 47 is located at a moving position between the work position and the die exchange position.

Therefore, when, for example, the ejector pipe 183 is lifted up in order to remove the die $D_2$, the die D2 can be surely lifted up by restricting upward movement of the lifter pipe 51 by the sliding stopper 155. As a result, exchange operation of the dies $D_1$, $D_2$ and D can be done efficiently.

Note that, as explained above, in the first embodiment, the dies $D_1$ and $D_2$ are installed in upper openings of the lifter pipes 51 and 53, respectively, as shown in FIG. 4(*a*), and the die D is installed in an upper opening of the lifter pipe 59 as shown in FIG. 4(*b*). In addition, in the second embodiment, the dies D ($D_1$ and $D_2$) are attached on upper portion of the lifter pipes 133 and 135, respectively, as shown in FIG. 9, and the die D is attached on an upper portion of the lifter pipe 137 as shown in FIG. 10. Therefore, with respect to the above-explained exchange of the die D, the "die" includes the die D ($D_1$, $D_2$ or D) as a die main body and the lifter pipe (die-base member) 51, 53, 59, 133, 135 or 137 that has the die D ($D_1$, $D_2$ or D) at its upper portion. In addition, the sliding stopper 155 (155A) can move between the lift restricting position and the lift allowing position explained above.

As explained above, the plural dies D are provided at the rotatable lower turret 13 along its circumferential direction, and the plural punches P are provided on the rotatable upper turret 7 along its circumferential direction, and the sliding stopper 155 (155A) is provided at each of the dies D, and the sliding stopper 155 (155A) is held at its lift restricting position by the lock spring 169, and the single stopper drive cylinder 159 for moving, against the lock spring 169, the sliding stopper 155 associating with the die D set at the work position is provided near the work position.

Therefore, since it is sufficient to provide the single stopper drive cylinder 159 so as to be shared by all of the die holders 47, the sliding stopper 155 (155A) can be unlocked at the work position by a simple configuration.

[Third Embodiment]

Figure 17:
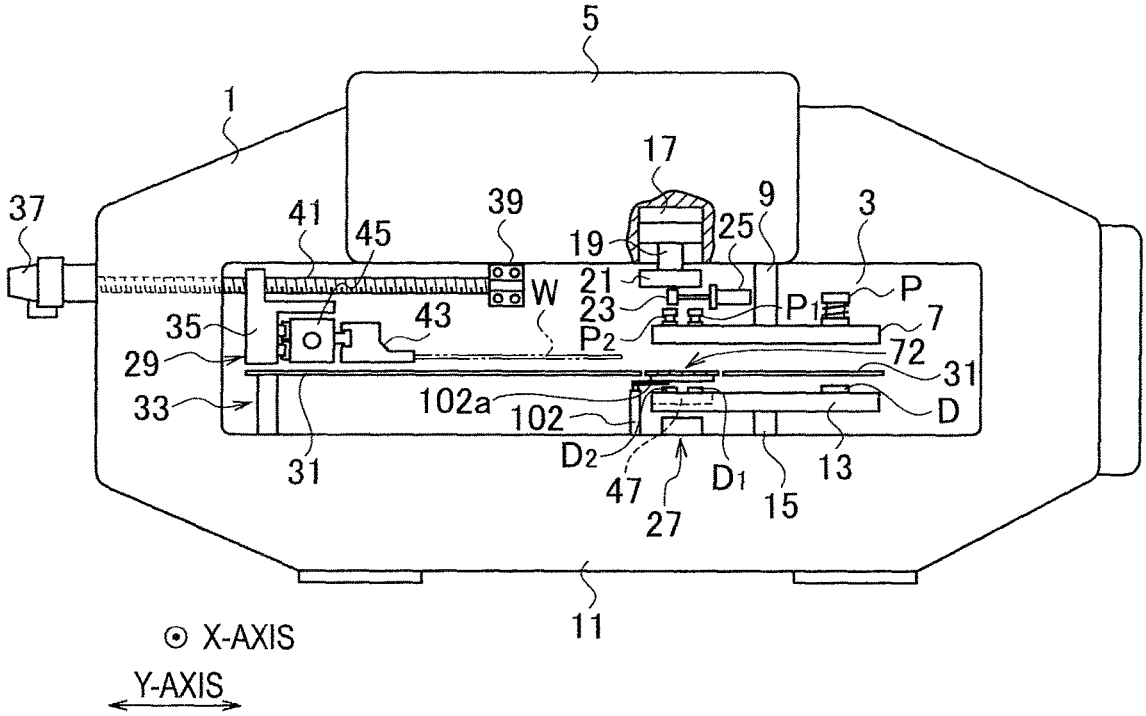
FIG. 17 It is a frond view showing an entire of a punch press according to a third embodiment.

FIG. 17 shows an entire of a turret punch press according to a third embodiment. Since the punch press according to the present embodiment has almost same configurations as those of the punch press according to the above-explained first embodiment, configurations different from those in the first embodiment will be explained in detail hereinafter. Explanations for configurations identical or similar to those in the first embodiment are omitted by adding identical reference numerals thereto.

Figure 18:
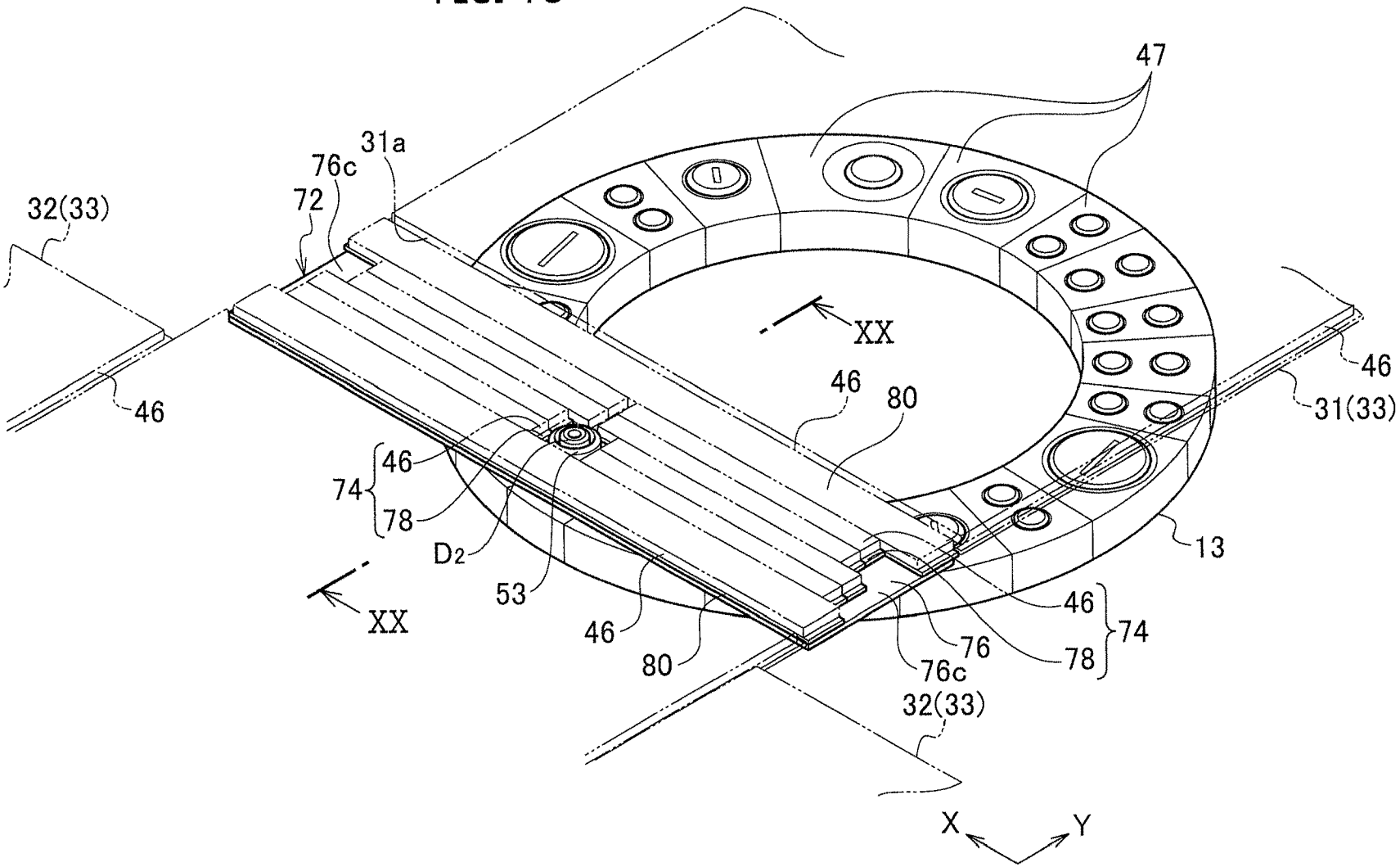
FIG. 18 It is a cross-sectional view showing a main portion of the punch press (when using a die $D_2$).

As explained in the first embodiment, the worktable 33 having the brushes 46 (see FIG. 19) on its surface is configured of the fixed table (the work support cover) 31 and the movable tables 32 (see FIG. 18). In the present embodiment, a brush-mounted shutter (a cover member) 72 is provided in the opening 31*a* formed on the fixed table 31. The brush-mounted shutter 72 has four shutter elements (cover member elements) 74 on each of both sides in the X-axis direction with the work position located at a middle of the both sides, i.e. has total eight. Each of the shutter elements 74 can independently slide relatively to a brush base 76 provided below them. The brushes 46 are mounted also on each base plate 78 of the shutter elements 74.

The brush base 76 is formed as a frame having a rectangular shape whose outline is almost fit to the opening 31*a*. A rectangular hole 76*a* is formed at an almost center of the brush base 76. The eight shutter elements 74 are arranged so as to form the hole 76*a*.

Fixed divided tables 80 are provided on both sides of the eight shutter elements 74 in the Y-axis direction, respectively. The divided tables 80 are fixed on long sides of the brush base 76 formed as a frame. The brushes 46 are mounted also on the divided tables 80.

As shown in FIG. 18, ends of the four shutter elements 74 extended along the X-axis direction with associated with the lifted-up die $D_2$ are contacted with (or made close to) an outer circumferential surface of the lifter pipe 53 that holds the die $D_2$. The remaining four shutter elements 74 are moved toward the work position, so that opposite ends in each of two pairs of the shutter elements 74 located oppositely are almost contacted with each other. In this state, punching by use of the die $D_2$ can be performed.

Figure 21:
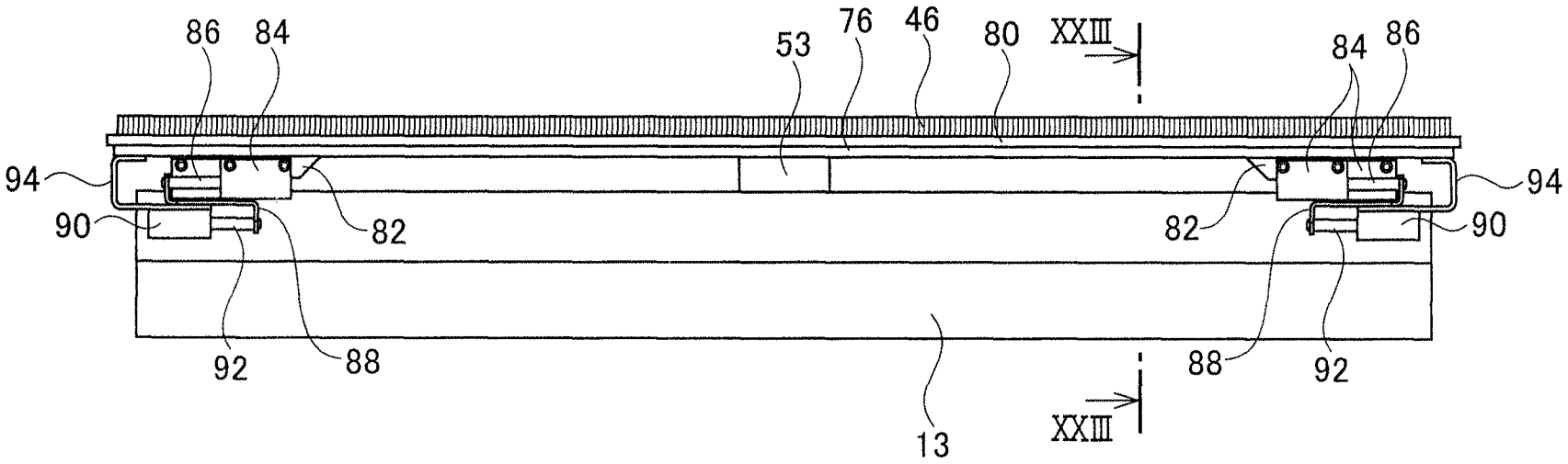
FIG. 21 It is a front view showing an environment of a brush-mounted shutter in the punch press.
Figure 22:
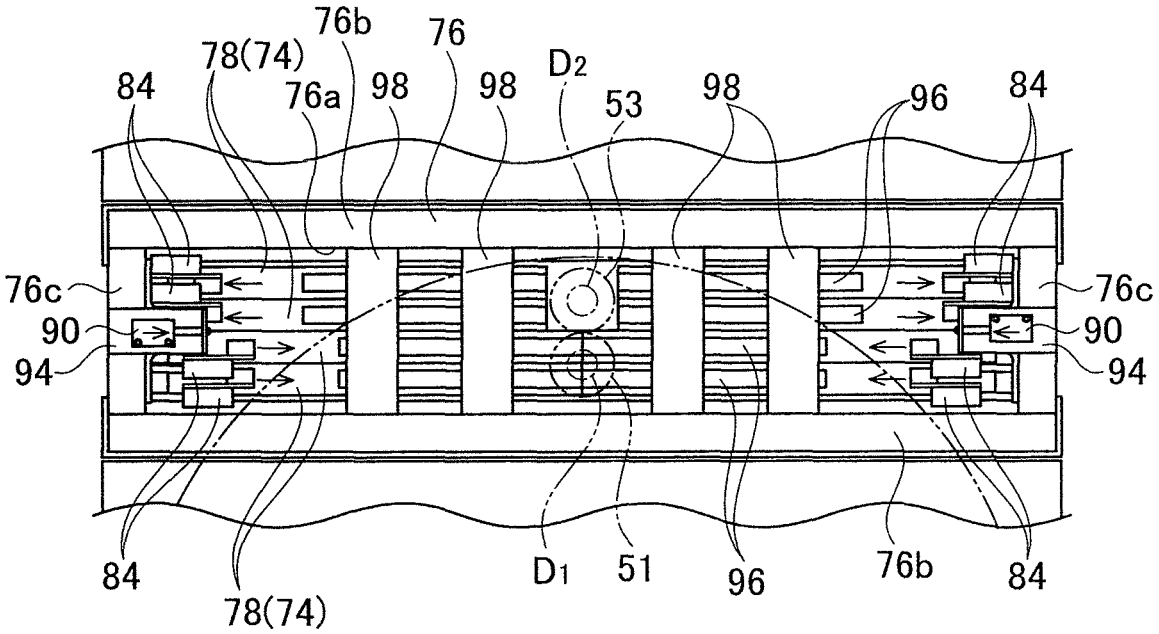
FIG. 22 It is a bottom view of the brush-mounted shutter.
Figure 24:
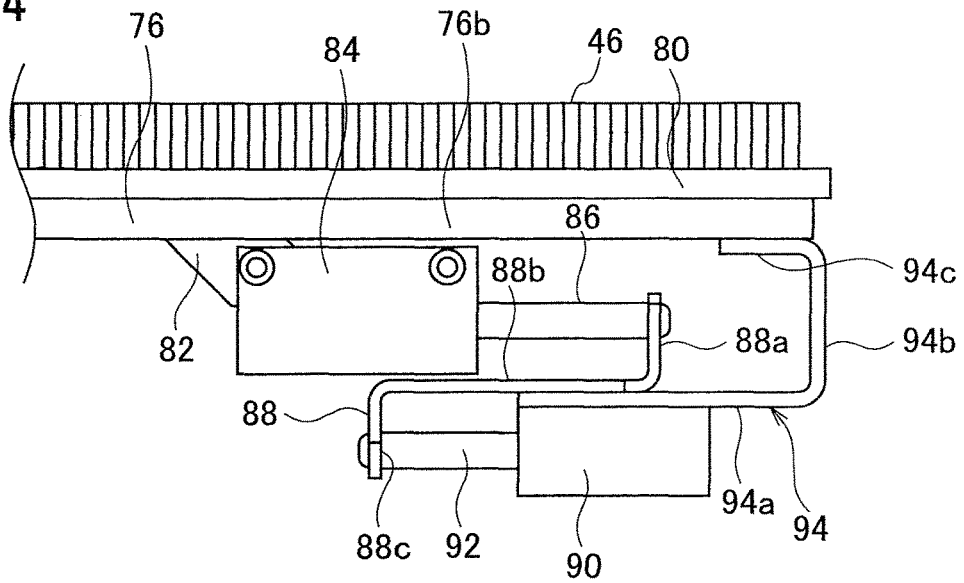
FIG. 24(*a*) is an enlarged front view showing a main portion in FIG. 21, and (*b*) is a bottom view of (*a*).
Figure 24:
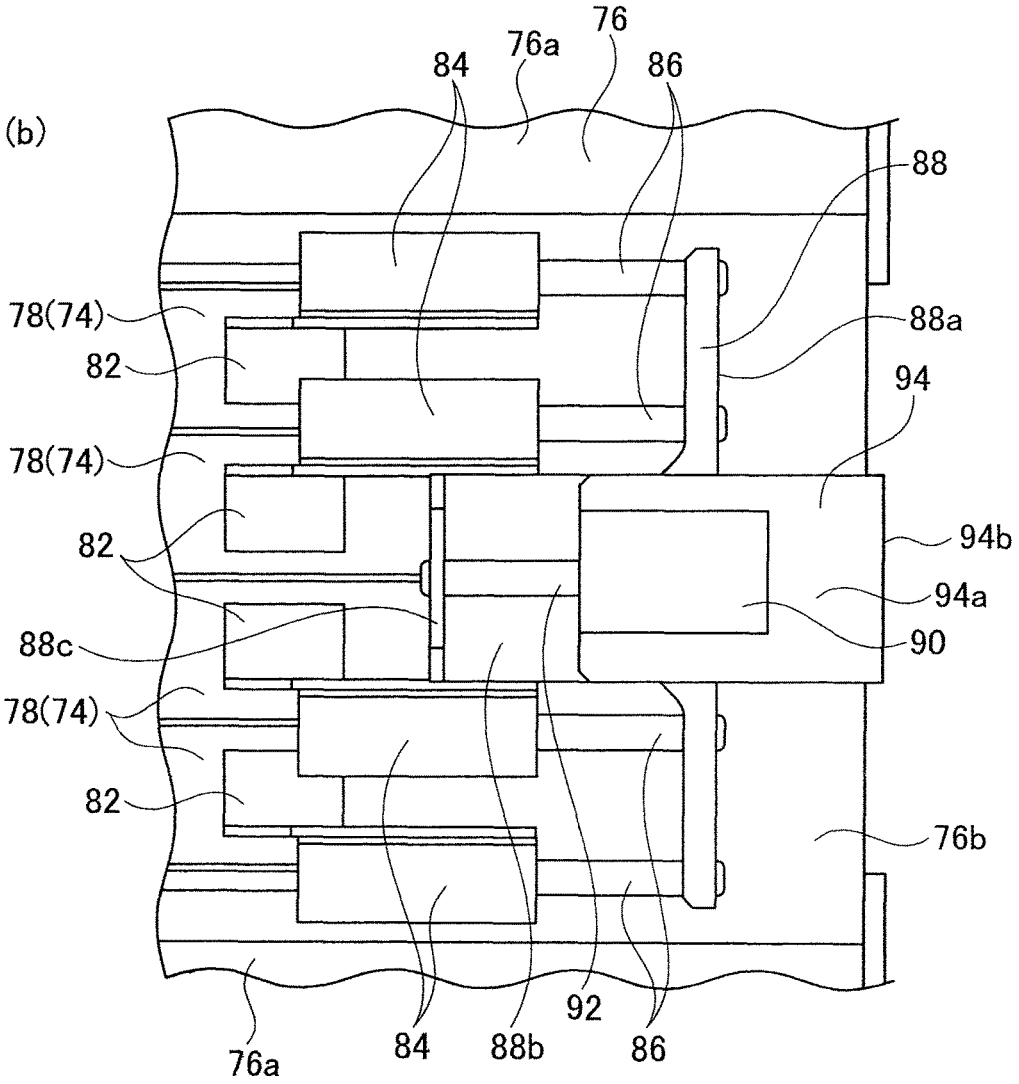

The shutter elements 74 and the brush base 76 are set so that portions near other ends on sides opposite to the work position in the eight shutter elements 74 are always located on short sides 76*c* of the brush base 76. As shown in FIG. 21 and FIG. 22, a first air cylinder 84 is attached on each of the shutter elements 74 (the base plates 78) via a cylinder bracket 82. Each piston rod 86 of the first air cylinders 84 projected toward a side opposite to the work position as shown in FIG. 24(*a*) and FIG. 24(*b*). Ends of the piston rods 86 are linked to a link bracket 88. The link bracket 88 links the first air cylinders 84 to an after-explained second air cylinder 90. Note that FIG. 24(*a*) and FIG. 24(*b*) show a state where all of the four air cylinders 84 are located at identical positions.

The link bracket 88 includes a first link tab 88*a*, an intermediate plate 88*b* and a second link tab 88*c* as shown in FIG. 24(*a*). The first link tab 88*a* is extended upward from an end of the intermediate plate 88*b* and connected with the piston rod 86. The second link tab 88*c* is extended downward from another end of the intermediate plate 88*b* and connected with a piston rod 92 of an after-explained second air cylinder 92.

The second air cylinder 92 is fixed on a bottom surface of a fixed bracket 94. The fixed bracket 94 includes a fixture tab 94*a*, a vertical wall 94*b* and an attachment tab 94*c*. The fixture tab 94*a* is parallel to the intermediate plate 88*b* of the link bracket 88 and located beneath the intermediate plate 88*b*. The vertical wall 94*b* is extended upward from an end opposite to the piston rod 92 in the fixture tab 94*a*. The attachment tab 94*c* is curved inward from an upper end of the vertical wall 94*b* and attached to a bottom surface of the short side 76*c* of the brush base 76.

Therefore, when the second air cylinder 90 is driven, the four shutter elements 74 are slid in the X-axis direction (a lateral direction in FIG. 24(*a*) and FIG. 24(*b*)) via the link bracket 88 and the first air cylinders 84. Further, when first air cylinders 84 are driven, the shutter elements 74 are independently slid in the X-axis direction via the cylinder brackets 82.

In addition, a slide rail 96 is attached to a bottom surface of the base plate 78 of each of the shutter elements 74 as shown in FIG. 22. On the other hand, bridge members 98 for bridging a pair of the long sides 76*b* are provided on a bottom surface of the brush base 76 so as to avoid the work position. Guide nuts 100 for guiding the slide rails 96 are fixed on each of the bridge members 98.

Therefore, the shutter elements 74 slide in the X-axis direction (a direction perpendicular to a drawing plane in FIG. 23) while the slide rails 96 are guided by the guide nuts 100.

Figure 23:
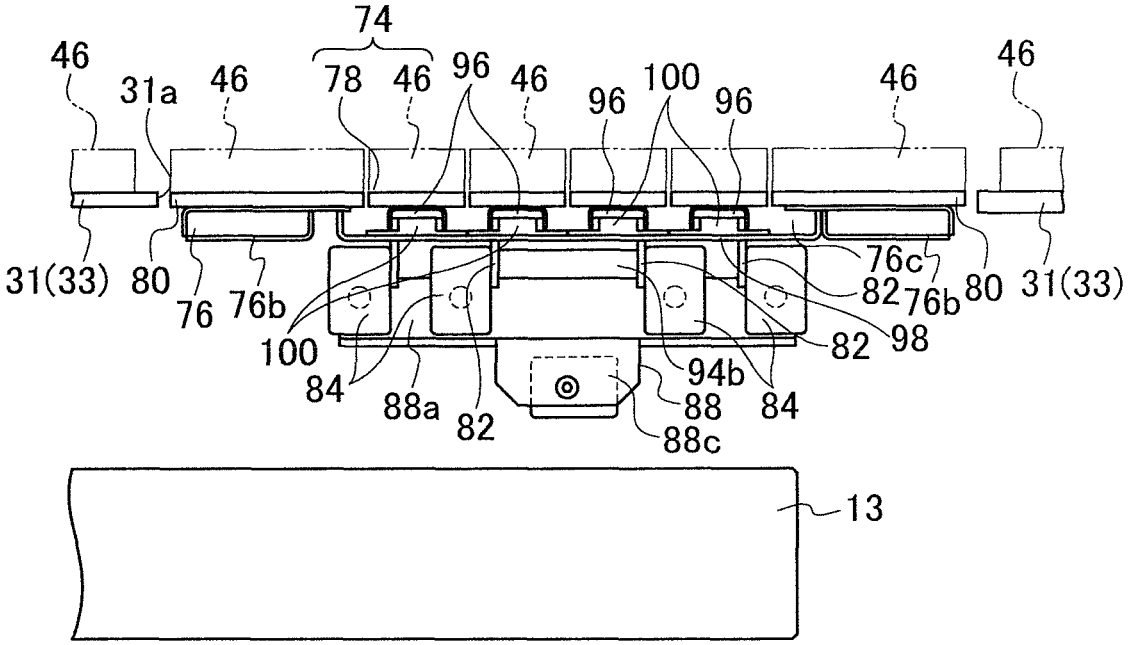
FIG. 23 It is a cross-sectional view taken along a line XXIII-XXIII in FIG. 21.

Note that structure shown in FIG. 23 and FIG. 24 associates with a right portion in FIG. 21 and FIG. 22, and similar symmetrical structure is constructed at a left portion. In addition, although support structure for the brush-mounted shutter 72 is not shown in FIG. 20, support posts 102 is mounted on the lower frame 11 and the brush base 76 is supported via arms 102*a* that are provided at upper ends of the support posts 102 and extended horizontally in the support structure as simply shown in FIG. 17.

Next, operation will be explained. FIG. 18 shows a state for punching by the die $D_2$ on the outer circumferential track ($T_3$) of the lower turret 13. In this case, the die $D_2$ is lifted up to the path line PL. Therefore, the ends of the four shutter elements 74 associating with the die $D_2$ are almost contacted with (or made close to) the outer circumferential surface of the lifter pipe 53 that holds the die $D_2$. Namely, the ends of the shutter elements 74 opposing to each other are distanced so as to form a gap having a width almost equivalent to a diameter of the lifter pipe 53.

On the other hand, the ends of the oppositely-located shutter elements 74 among the four shutter elements 74 associating with the die $D_1$ are almost contacted with each other. Namely, these shutter elements 74 close an entering area for the die $D_1$ within the opening 31*a*.

In this case, the second air cylinders 90 are extended and the four first air cylinders 84 associating with the die $D_1$ are extended as shown in FIG. 22. Concurrently, the four first air cylinders 84 associating with the die $D_2$ are shortened. Note that, when the first or second air cylinder 84 or 90 is extended, the piston rod 86 or 92 is projected. When the first or second sir cylinder 84 or 90 is shortened, the piston rod 86 or 92 is retracted.

Here, when the work W is to be conveyed to the work position by the alignment unit 29 shown in FIG. 17, the die D2 and the lifter pipe 53 are made taken down by taking down the lift ram 65 (see FIG. 7(*a*) and FIG. 7(*b*)). At this moment, an entering area (a square opening) for the lifter pipe 53 is formed at the work position as shown in FIG. 22.

Therefore, especially even in a case where the work W is curved so as to be convex toward the fixed table 31 (downward), contacts between the work W and the die $D_2$ can be prevented effectively because the opening area is made narrow in conformity to a size of the die $D_2$ to be used. As a result, operations for aligning the work W to the work position can become ease and damages on surfaces of the work W can be prevented.

When the work has been set at the work position, the lift ram 65 is lifted up. The attachment 67 is also lifted up by lifting-up of the lift ram 65. At this time, the protruded portion 67*a* of the attachment 67 contacts with the lower end of the lifter pipe 53, so that the die $D_2$ and the lifter pope 53 at the work position are entered into the gap (the square opening in FIG. 22) between the ends of the shutter elements 74 distanced with each other as shown in FIG. 18.

At this moment, the upper end of the die $D_2$ is coincident with the path line PL as shown in FIG. 18. In this state, the punch P associating with the die $D_2$ is struck by the striker 23 and thereby high quality and stable punching can be performed. After completion of punching, the die $D_2$ is took down together with the lifter pipe 53.

Figure 25:
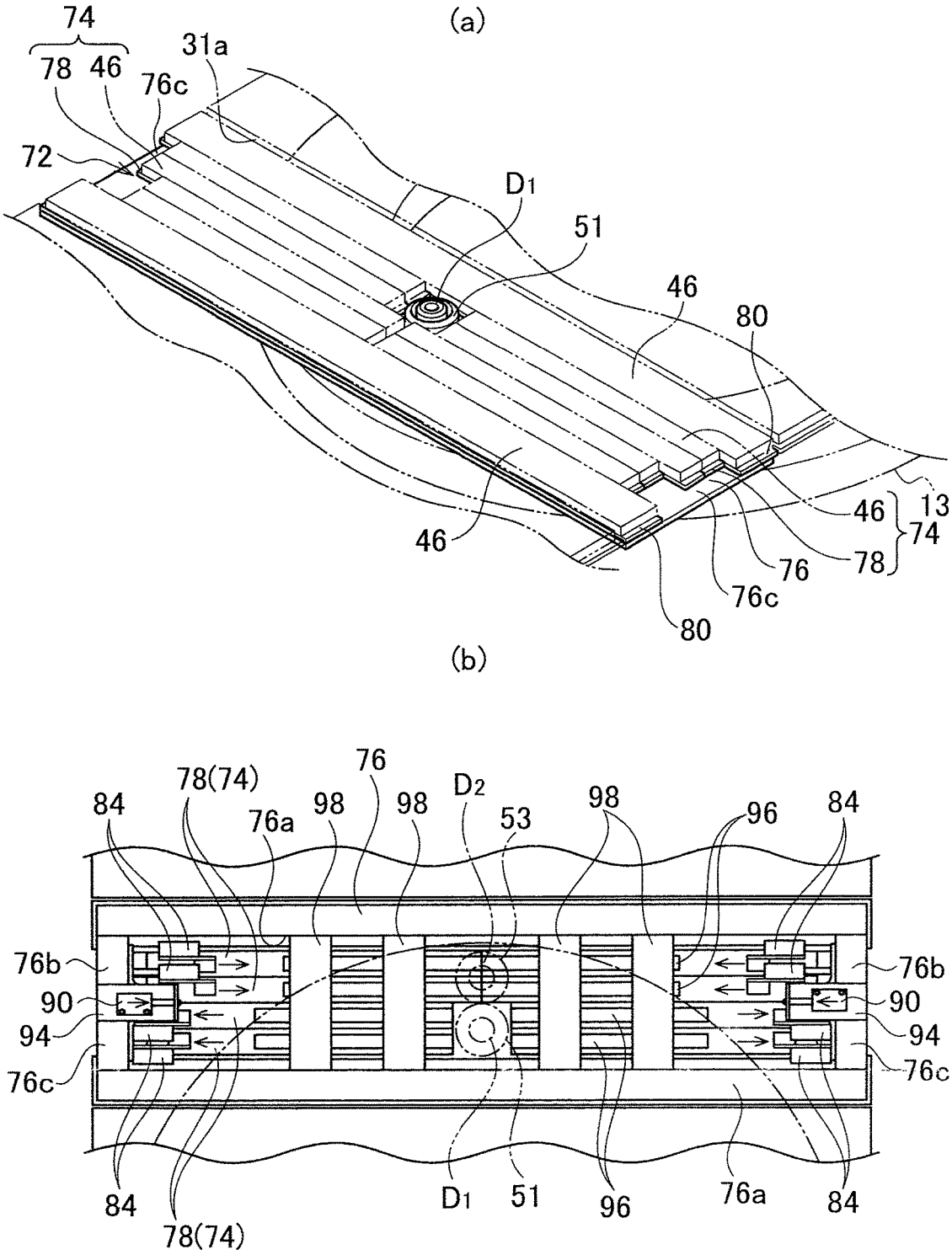
FIG. 25(*a*) is a perspective view showing a main portion and (*b*) is a bottom view of the brush-mounted shutter, when using a die $D_1$.

In addition, as shown in FIG. 25(*a*), in a case for punching by the die $D_1$on the inner circumferential track ($T_1$), the die $D_1$ is lifted up to the path line PL. Therefore, the ends of the four shutter elements 74 associating with the die $D_1$ are almost contacted with (or made close to) the outer circumferential surface of the lifter pipe 51 that holds the die $D_1$. Namely, the ends of the oppositely-located shutter elements 74 in the X-axis direction are distanced to each other so as to form a gap having a width almost equivalent to a diameter of the lifter pipe 51.

On the other hand, the ends of the oppositely-located shutter elements 74 among the four shutter elements 74 associating with the die $D_2$ are almost contacted with each other. Namely, these shutter elements 74 close an entering area for the die $D_2$ within the opening 31*a*.

In this case, the second air cylinders 90 are extended and the four first air cylinders 84 associating with the die $D_2$ are extended as shown in FIG. 25(*b*). Concurrently, the four first air cylinders 84 associating with the die $D_1$ are shortened.

At this time, the attachment 75 is used in order to lift up the die $D_1$ (see FIG. 7 (*b*)). Processes for conveying the work W and punching are similar to those in the case shown by FIG. 18.

Therefore, in this case, an entering area (a square opening) for the lifter pipe 51 is formed at the work position as shown in FIG. 25 (*b*). Thus, especially even in a case where the work W is curved so as to be convex toward the fixed table 31 (downward), contacts between the work W and the die $D_1$ can be prevented effectively because the opening area is made narrow in conformity to a size of the die $D_1$ to be used. As a result, operations for aligning the work W to the work position can become ease and damages on surfaces of the work W can be prevented.

Figure 26:
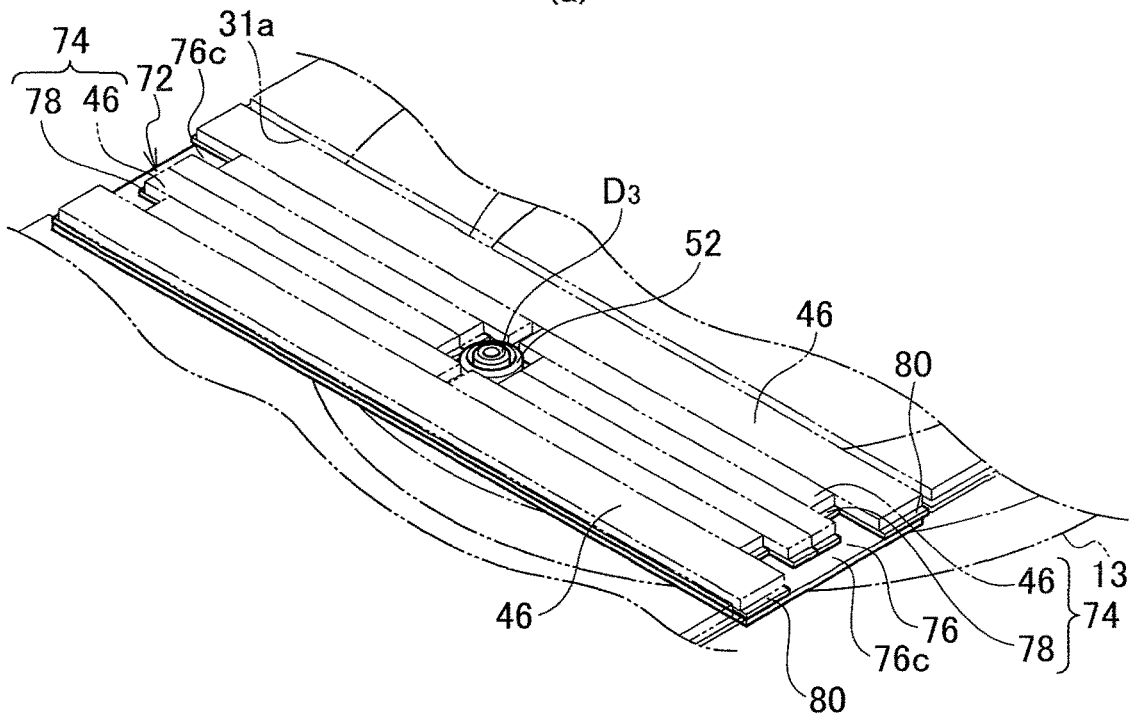
FIG. 26(*a*) is a perspective view showing the main portion and (*b*) is a bottom view of the brush-mounted shutter, when using a die $D_3$.
Figure 26:
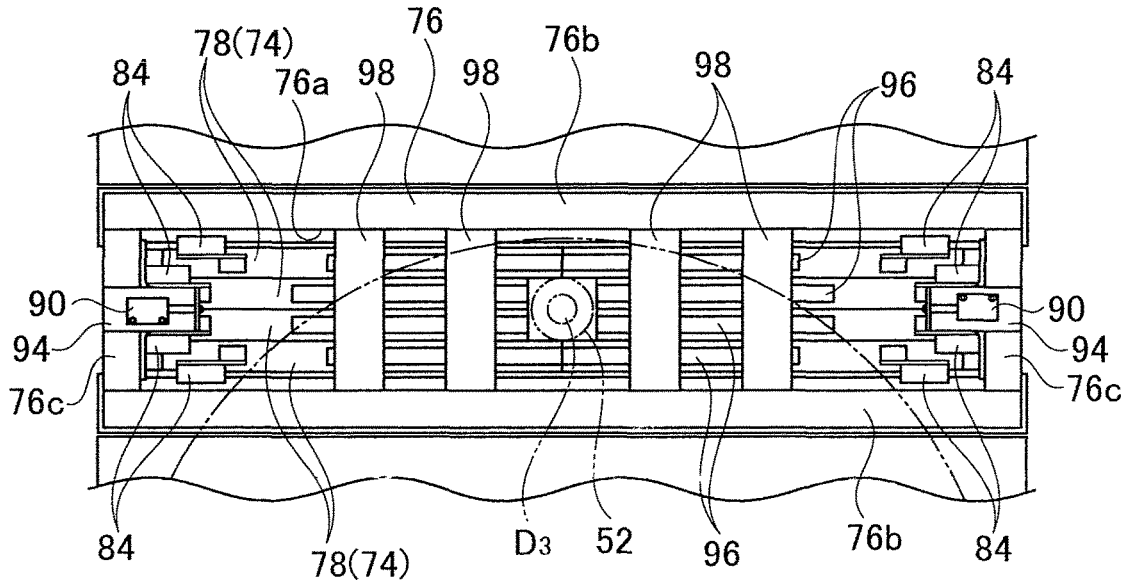

In addition, as shown in FIG. 26(*a*), in a case for punching by a small-diameter die $D_3$ (almost equivalent to the diameter of the die $D_1$ or $D_2$) on the center track ($T_2$), the die $D_3$ is lifted up to the path line PL. Therefore, the ends of the four shutter elements 74 associating with the die $D_3$ are almost contacted with (or made close to) an outer circumferential surface of a lifter pipe 52 that holds the die $D_3$. Namely, the ends of the oppositely-located shutter elements 74 in the X-axis direction are distanced to each other so as to form a gap having a width almost equivalent to a diameter of the lifter pipe 52.

On the other hand, the ends of the oppositely-located remaining four shutter elements 74 are almost contacted with each other. Namely, these shutter elements 74 close an area within the opening 31*a* other than an entering area for the die $D_3$.

In this case, the second air cylinders 90 are extended and the four first air cylinders 84 associating with the die $D_3$ are shortened as shown in FIG. 26(*b*). Concurrently, the remaining four first air cylinders 84 are extended.

Figure 20:
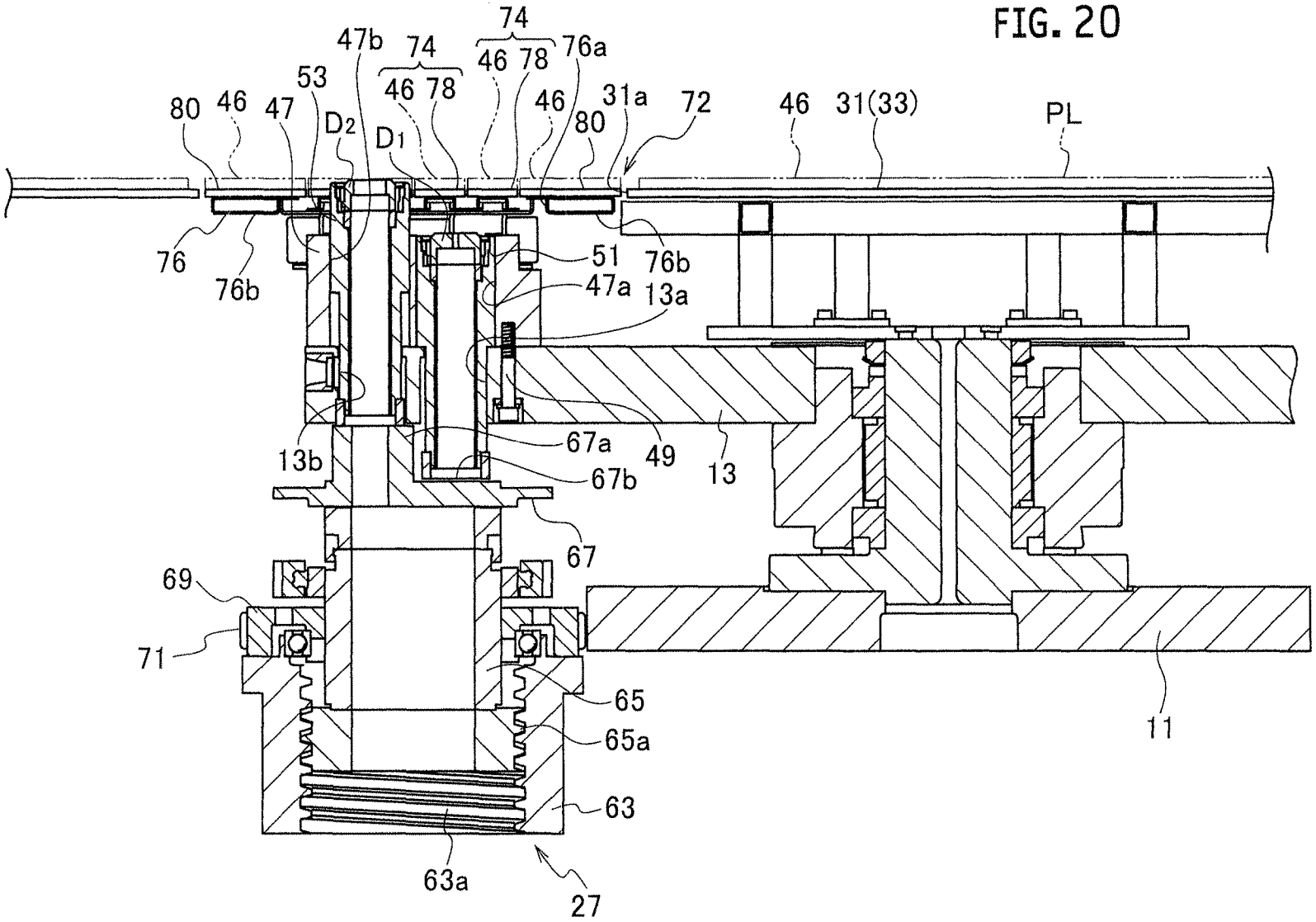
FIG. 20 It is a cross-sectional view taken along a line XX-XX in FIG. 18.

At this time, an attachment for the die $D_3$ is used in order to lift up the die $D_3$ instead of the attachment 67 shown in FIG. 20. Processes for conveying the work W and punching are similar to those in the case shown by FIG. 18.

Therefore, in this case, an entering area (a square opening) for the lifter pipe 52 is formed at the work position as shown in FIG. 26(*b*). Thus, especially even in a case where the work W is curved so as to be convex toward the fixed table 31 (downward), contacts between the work W and the die $D_3$ can be prevented effectively because the opening area is made narrow in conformity to a size of the die $D_3$ to be used. As a result, operations for aligning the work W to the work position can become ease and damages on surfaces of the work W can be prevented.

Figure 27:
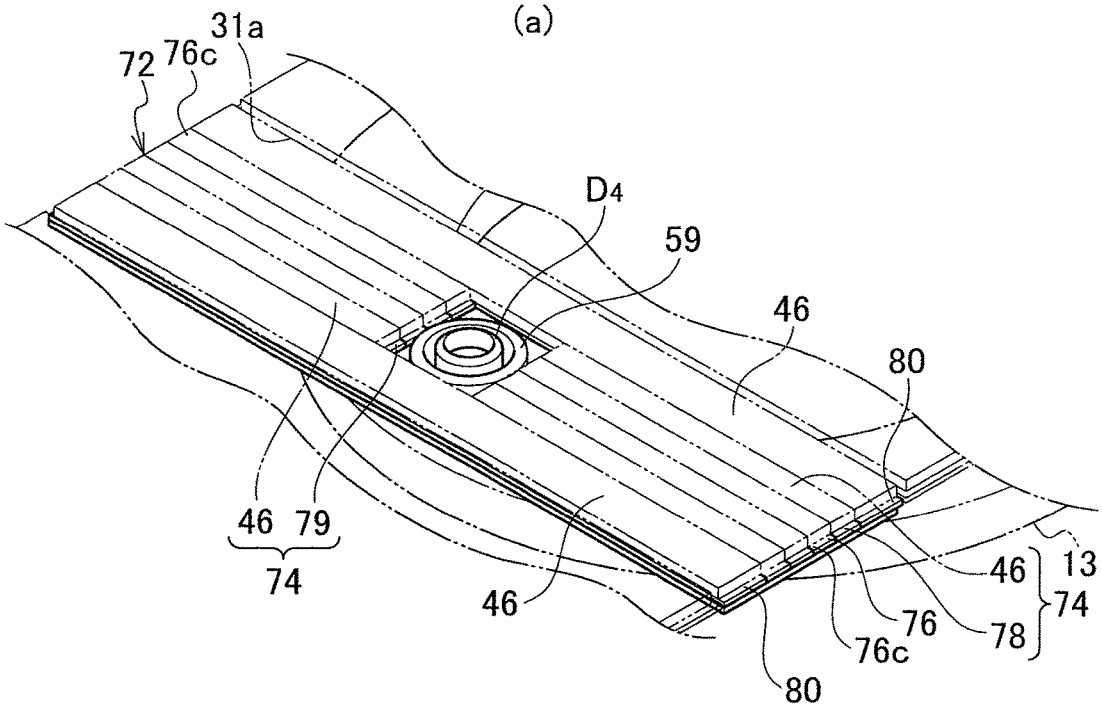
FIG. 27(*a*) is a perspective view showing the main portion and (*b*) is a bottom view of the brush-mounted shutter, when using a die $D_4$.
Figure 27:
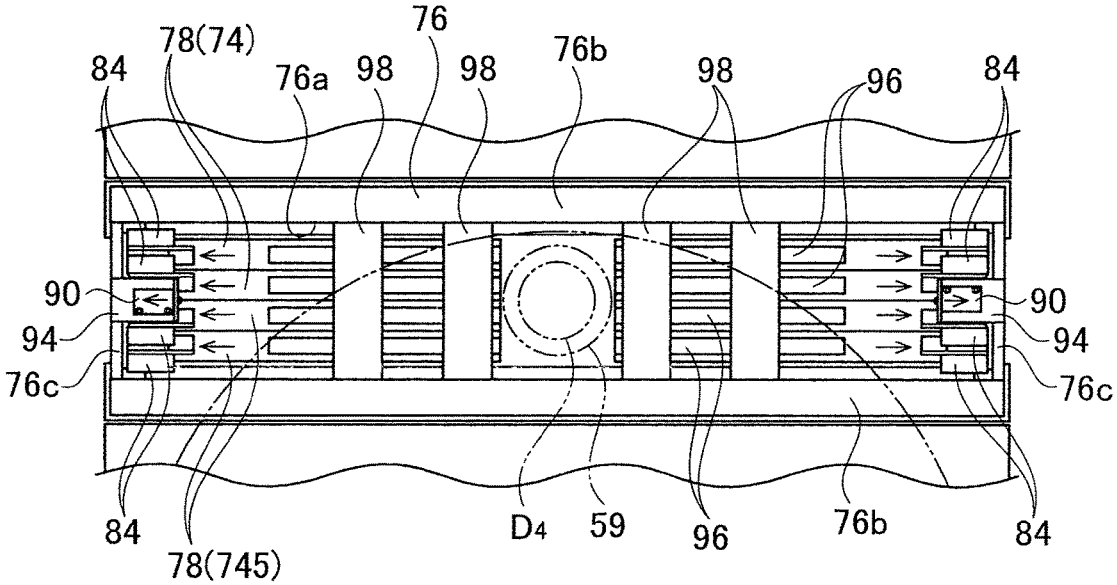

In addition, as shown in FIG. 27(*a*), in a case for punching by a large-diameter die $D_4$ on the center track ($T_2$), the die $D_4$ is lifted up to the path line PL. Therefore, the ends of all the eight shutter elements 74 associating with the die $D_4$ are almost contacted with (or made close to) the outer circumferential surface of the lifter pipe 59 that holds the die $D_4$. Namely, the ends of the oppositely-located shutter elements 74 in the X-axis direction are distanced to each other so as to form a gap having a width almost equivalent to a diameter of the lifter pipe 59.

In this case, the second air cylinders 90 are shortened and all of the first air cylinders 84 are also shortened as shown in FIG. 27(*b*).

At this time, the attachment 77 is used in order to lift up the die $D_1$ (see FIG. 8(*b*)). Note that the attachment for the die $D_3$ and the attachment 77 for the die $D_4$ may be integrated because the die $D_3$ and the die $D_4$ are similarly positioned on the center track. In this case, the lifter pipe 52 for the die $D_3$ is configured so that a lower end inner diameter of the lifter pipe 52 is made equivalent to an inner diameter of the attachment 77 for the die $D_4$ and an upper end inner diameter of the die $D_3$ is made equivalent to an inner diameter of the die $D_3$. Processes for conveying the work W and punching are similar to those in the case shown by FIG. 18.

Therefore, in this case, an entering area (a square opening) for the lifter pipe 59 is formed at the work position as shown in FIG. 27(*b*). Thus, especially even in a case where the work W is curved so as to be convex toward the fixed table 31 (downward), contacts between the work W and the die $D_4$ can be prevented effectively because the opening area is made narrow in conformity to a size of the die $D_4$ to be used. As a result, operations for aligning the work W to the work position can become ease and damages on surfaces of the work W can be prevented.

Figure 28:
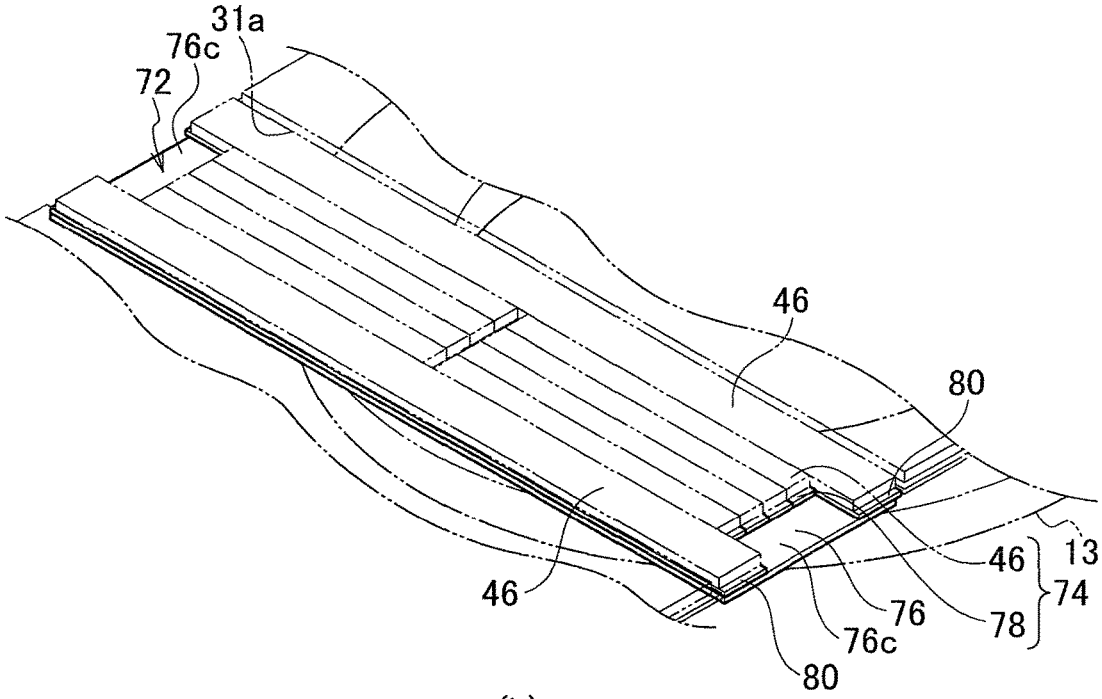
FIG. 28(*a*) is a perspective view showing the main portion and (*b*) is a bottom view of the brush-mounted shutter, during laser processing.
Figure 28:
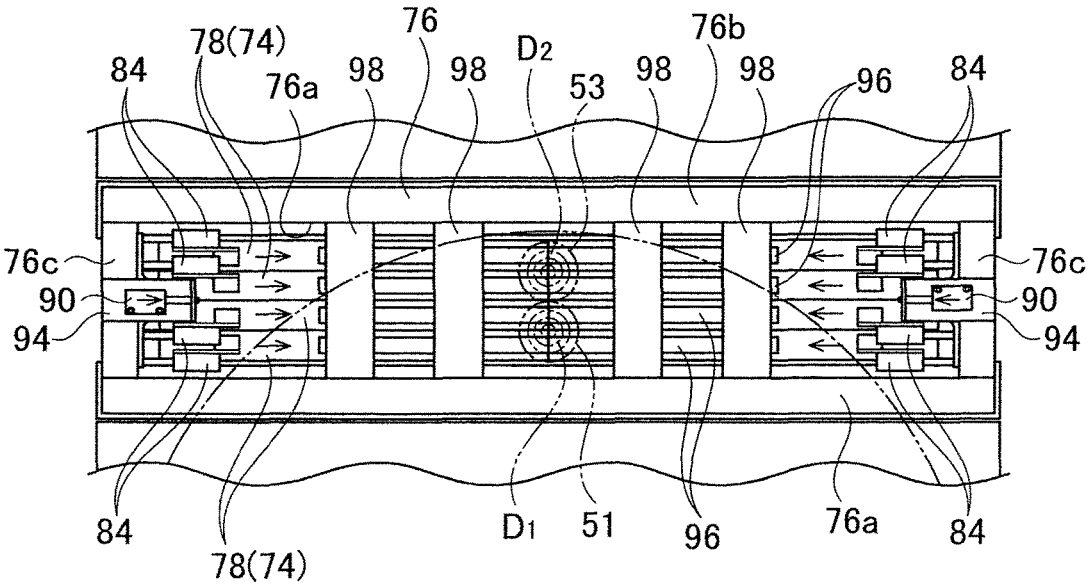

Therefore, FIG. 28(*a*) and FIG. 28(*b*) show the brush-mounted shutter 72 in a case where punching is not performed by the die D, for example, laser processing is performed. In this case, the ends of the oppositely-located shutter elements 74 are almost contacted with each other. Namely, an area at the work position is closed so that the die(s) D can't enter thereto.

Therefore, in this case, especially even in a case where the work W is curved so as to be convex toward the fixed table 31 (downward), contacts between the work W and the die D never happen because the opening 31*a* is closed. As a result, operations for aligning the work W to the work position can become ease and damages on surfaces of the work W can be prevented.

As explained above, the shutter elements 74 can be slid in two steps by the first and second air cylinders 84 and 90 in the present embodiment. The shutter elements 74 can be set to three positions by being slid in two steps, a position where the ends thereof are substantially contacted with the lifter pipe 51, 53 or 52 for the small-diameter die $D_1$, $D_2$ or $D_3$ (FIG. 25(*a*), FIG. 18 or FIG. 26(*a*)), a position where the ends thereof are substantially contacted with the lifter pipe 59 for the large-diameter die $D_4$ (FIG. 27(*a*)), and a position where the ends thereof are substantially contacted with each other (FIG. 28(*a*)).

Note that the brush-mounted shutter 72 can be applied to a lifter pipe that has a different diameter from that of the lifter pipe 51, 53, 52 or 59 by adequately adjusting operational strokes of the first and second air cylinders 84 and 90.

Note that, in the cases shown in FIG. 18, FIG. 25 (*a*), FIG. 26 (*a*) and FIG. 27(*a*), the opening 31*a* may be closed as shown in FIG. 28 (*a*) while the work W is conveyed. After the work W has been set at the work position, the shutter elements 74 are set in the state shown in FIG. 18, FIG. 25(*a*), FIG. 26(*a*) or FIG. 27 (*a*). According to this, contacts between the work W and the die(s) D can be prevented more securely.

[Fourth Embodiment]

Next, a fourth embodiment will be explained with reference to FIG. 29 to FIG. 32. In the present embodiment, four shutter elements 104 are used instead of the eight shutter elements 84 in the third embodiment. Namely, the shutter element 104 has the same length along the X-axis direction as that of the shutter element 74, but has a width along the Y-axis direction almost as twice as that of the shutter element 74.

In addition, a slide mechanism for the shutter elements 104 is configured of four first air cylinders (84) for sliding the shutter elements 104 in the X-axis direction and two second air cylinders (90) each for sliding, on one side, all the first air cylinder (84) in the X-axis direction, similarly to the third embodiment.

Figure 29:
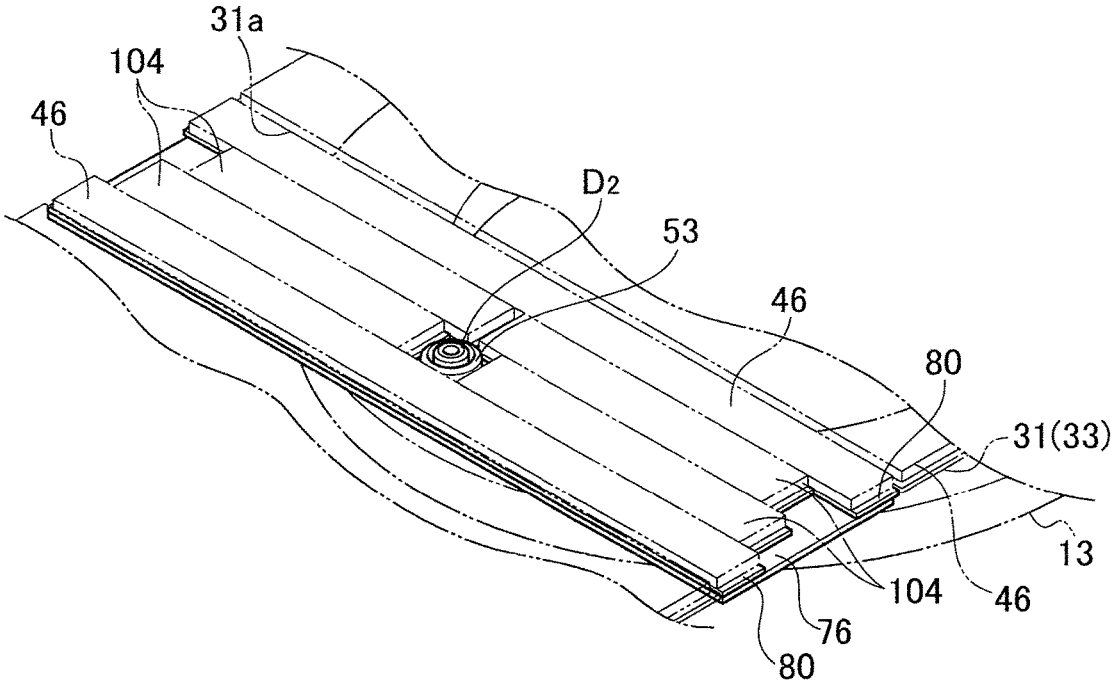
FIG. 29 It is a cross-sectional view showing a main portion of a punch press according to a fourth embodiment (when using a die $D_2$).

In a case for punching by the die $D_2$, the ends of the two shutter elements 104 associating the die $D_2$ are almost contacted with (or made close to) the outer circumferential surface of the lifter pipe 53 that holds the die $D_2$ as shown in FIG. 29. Namely, the ends of the oppositely-located shutter elements 104 in the X-axis direction are distanced to each other so as to form a gap having a width almost equivalent to a diameter of the lifter pipe 53.

On the other hand, the ends of the oppositely-located shutter elements 104 associating with the die $D_1$ are almost contacted with each other. Namely, these shutter elements 104 close an entering area for the die $D_1$ within the opening 31*a*.

In this case, the second air cylinders (90) are extended and the two first air cylinders (84) associating with the die $D_1$ are extended. Concurrently, the two first air cylinders (84) associating with the die $D_2$ are shortened.

Figure 30:
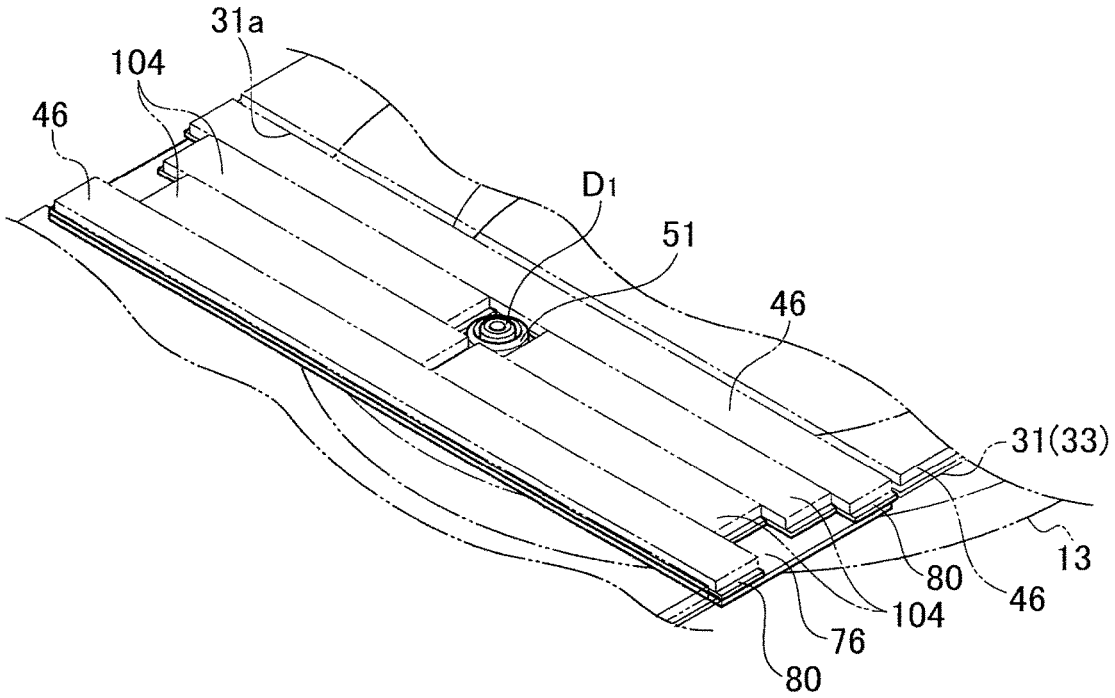
FIG. 30 It is a perspective view showing the main portion when using a die $D_1$.

In a case for punching by the die $D_1$, the ends of the two shutter elements 104 associating with the die $D_1$ are almost contacted with (or made close to) the outer circumferential surface of the lifter pipe 51 that holds the die $D_1$ as shown in FIG. 30. Namely, the ends of the oppositely-located shutter elements 104 in the X-axis direction are distanced to each other so as to form a gap having a width almost equivalent to a diameter of the lifter pipe 51.

On the other hand, the ends of the oppositely-located shutter elements 104 associating with the die $D_2$ are almost contacted with each other. Namely, these shutter elements 104 close an entering area for the die $D_2$ within the opening 31*a*.

In this case, the second air cylinders (90) are extended and the two first air cylinders (84) associating with the die $D_2$ are extended. Concurrently, the two first air cylinders (84) associating with the die $D_1$ are shortened.

Figure 31:
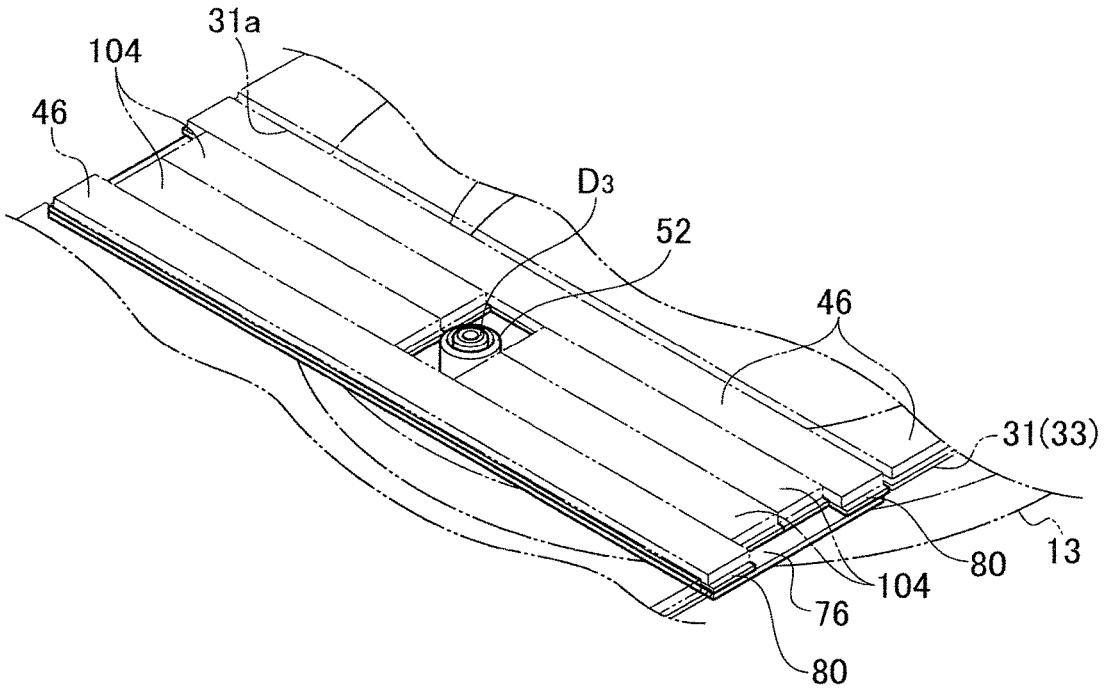
FIG. 31 It is a perspective view showing the main portion when using a die $D_3$.

In a case for punching by the die $D_3$, the ends of all of the shutter elements 104 associating with the die $D_3$ are almost contacted with (or made close to) the outer circumferential surface of the lifter pipe 52 that holds the die $D_3$ as shown in FIG. 31. Namely, the ends of the oppositely-located shutter elements 104 in the X-axis direction are distanced to each other so as to form a gap having a width almost equivalent to a diameter of the lifter pipe 52.

In this case, the second air cylinders (90) are extended and all of the first air cylinders (84) are shortened.

Figure 32:
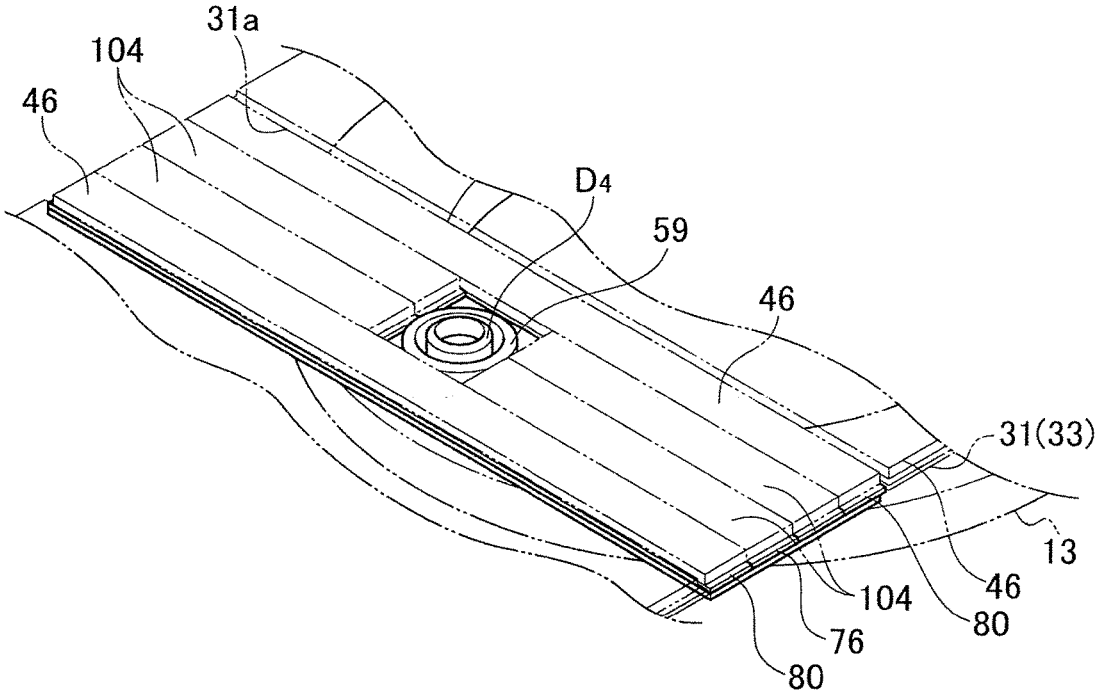
FIG. 32 It is a perspective view showing the main portion when using a die $D_4$.

In a case for punching by the die $D_4$, the ends of all of the shutter elements 104 associating the die $D_4$ are almost contacted with (or made close to) the outer circumferential surface of the lifter pipe 59 that holds the die $D_4$ as shown in FIG. 32. Namely, the ends of the oppositely-located shutter elements 104 in the X-axis direction are distanced to each other so as to form a gap having a width almost equivalent to a diameter of the lifter pipe 59.

In this case, the second air cylinders (90) are shortened and all of the first air cylinders (84) are shortened.

Of course, the present embodiment can be also applied to a case where punching is not performed by the die D, for example, laser processing is performed, similarly to FIG. 28(*a*) and FIG. 28(*b*). In this case, the ends of the oppositely-located shutter elements 104 are almost contacted with (or made close to) each other and an area at the work position is closed so that the die(s) D can't enter thereto.

Therefore, also in the present embodiment, a narrow opening is formed as an entering area for the die D to be used at the work position, or the entering area is closed. Thus, especially even in a case where the work W is curved so as to be convex toward the fixed table 31 (downward), contacts between the work W and the die D can be prevented effectively. As a result, operations for aligning the work W to the work position can become ease and damages on surfaces of the work W can be prevented.

[Fifth Embodiment]

Next, a fifth embodiment will be explained with reference to FIG. 33 to FIG. 36. In the present embodiment, two shutter elements 106 are used instead of the eight shutter elements 84 in the third embodiment. Namely, the shutter element 106 has the same length along the X-axis direction as that of the shutter element 74, but has a width along the Y-axis direction almost as four times as that of the shutter element 74. In addition, corner tabs 106*a* each having a triangular shape are extended from width-direction (Y-axis direction) side edges of ends of the shutter elements 106 oppositely-located to each other.

In addition, a slide mechanism for the shutter elements 106 is configured of second air cylinders (90) for sliding the shutter elements 106 in the X-axis direction. Namely, piston rods (92) of the second air cylinders (90) are fixed to brackets provided on bottom surfaces of the base plates 78 of the shutter elements 106, respectively. The second air cylinders (90) are fixed on bottom surface of the brush base 76 via fixed brackets (94), respectively.

Figure 33:
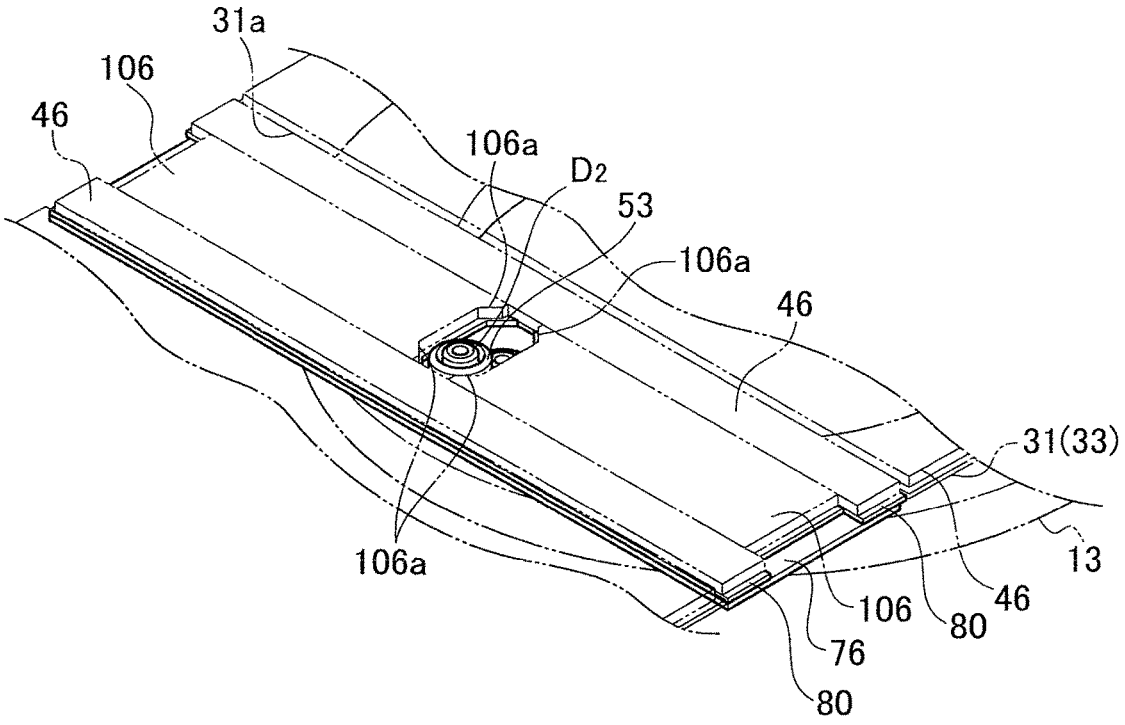
FIG. 33 It is a cross-sectional view showing a main portion of a punch press according to a fifth embodiment (when using a die $D_2$).

In a case for punching by the die $D_2$, ends of the shutter elements 106 are almost contacted with (or made close to) the outer circumferential surface of the lifter pipe 53 that holds the die $D_2$ as shown in FIG. 33. Namely, ends of the oppositely-located shutter elements 106 in the X-axis direction are distanced to each other so as to form a gap having a width almost equivalent to a diameter of the lifter pipe 53. In this case, the second air cylinders (90) are extended.

In this case, an entering area for the die $D_1$ is not closed but opened, and its opened area size becomes larger than that in the case shown in FIG. 18 or FIG. 29(*a*). However, the opened area is made as narrow as possible by the corner tabs 106*a*.

Figure 34:
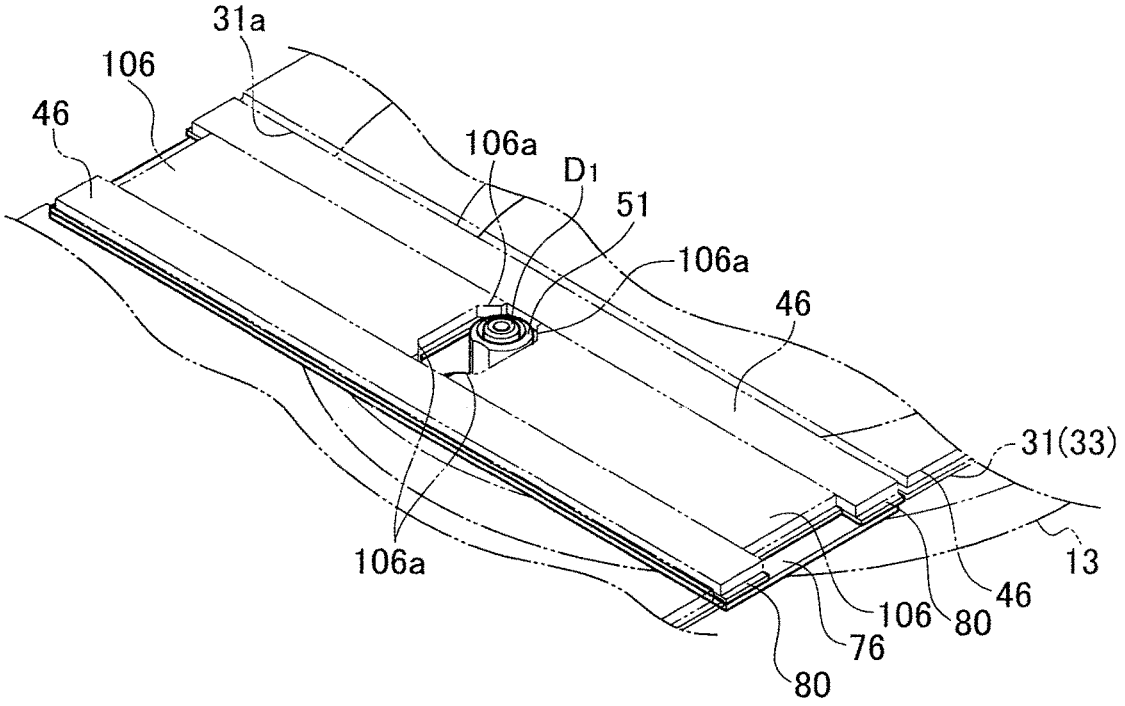
FIG. 34 It is a perspective view showing the main portion when using a die $D_1$.

In a case for punching by the die $D_1$, the ends of the shutter elements 106 associating with the die $D_1$ are almost contacted with (or made close to) the outer circumferential surface of the lifter pipe 51 that holds the die $D_1$ as shown in FIG. 34. Namely, the ends of the oppositely-located shutter elements 106 in the X-axis direction are distanced to each other so as to form a gap having a width almost equivalent to a diameter of the lifter pipe 51. In this case, the second air cylinders (90) are extended.

In this case, an entering area for the die $D_2$ is not closed but opened, and its opened area size becomes larger than that in the case shown in FIG. 25 (*a*) or FIG. 30(*a*). However, the opened area is made as narrow as possible by the corner tabs 106*a*.

Figure 35:
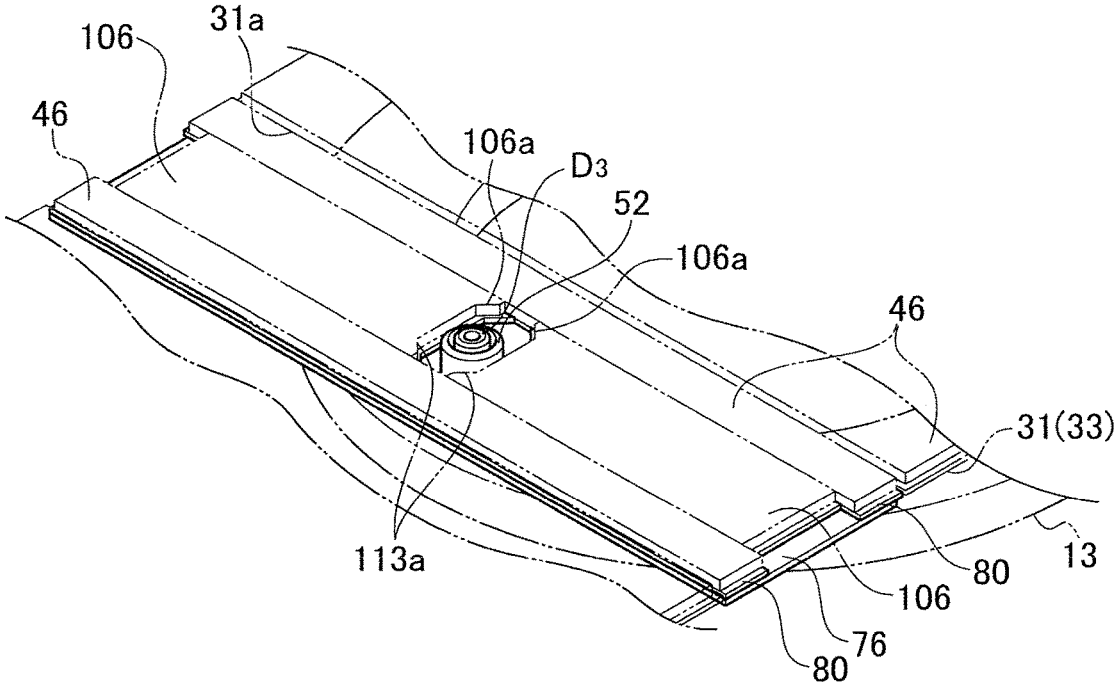
FIG. 35 It is a perspective view showing the main portion when using a die $D_3$.

In a case for punching by the die $D_3$, the ends of the shutter elements 106 are almost contacted with (or made close to) the outer circumferential surface of the lifter pipe 52 that holds the die $D_3$ as shown in FIG. 35. Namely, the ends of the oppositely-located shutter elements 106 in the X-axis direction are distanced to each other so as to form a gap having a width almost equivalent to a diameter of the lifter pipe 52. In this case, the second air cylinders (90) are extended.

In this case, both side areas of the die $D_3$ are not closed but opened, and its opened area size becomes larger than that in the case shown in FIG. 26. However, the opened area is made as narrow as possible by the corner tabs 106*a*.

Figure 36:
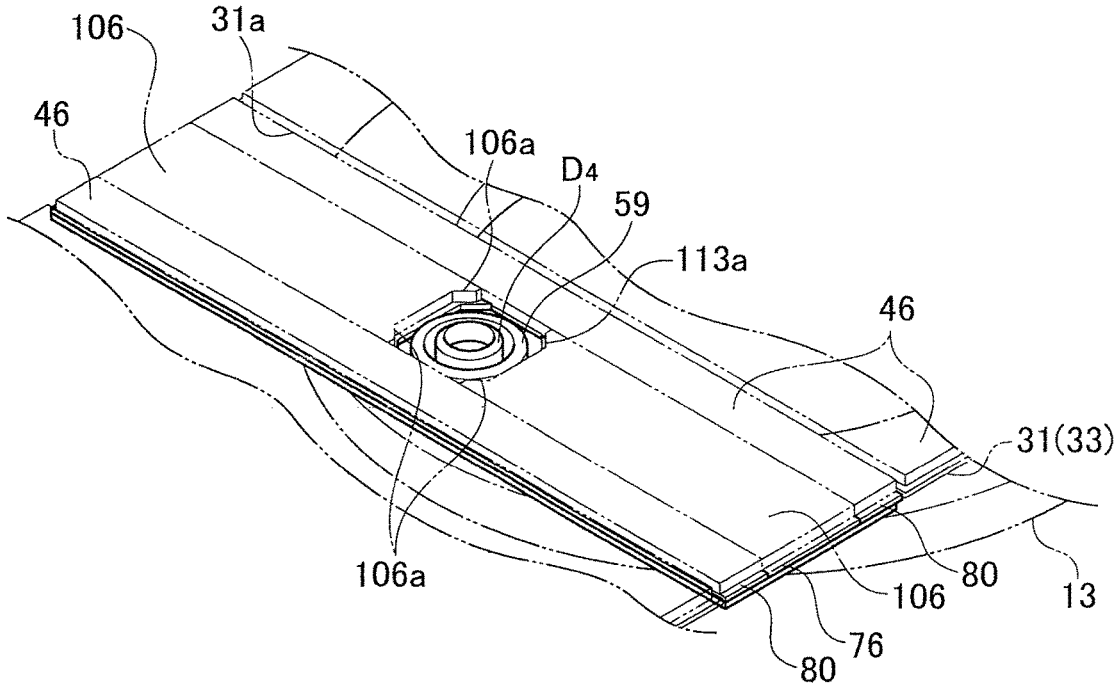
FIG. 36 It is a perspective view showing the main portion when using a die $D_4$.

In a case for punching by the die $D_4$, the ends of the shutter elements 106 are almost contacted with (or made close to) the outer circumferential surface of the lifter pipe 59 that holds the die $D_4$ as shown in FIG. 36. Namely, the ends of the oppositely-located shutter elements 106 in the X-axis direction are distanced to each other so as to form a gap having a width almost equivalent to a diameter of the lifter pipe 59. In this case, the second air cylinders (90) are shortened.

In this case, the opened area is partially closed by the corner tabs 106*a*, so that the opened area is made narrower than that in the case shown in FIG. 27(*a*) or FIG. 32.

As explained above, the shutter elements 106 can be slid in a single step by the second air cylinders (90) in the present embodiment. The shutter elements 106 can be set to two positions by being slid in a single step, a position where the ends thereof are substantially contacted with the lifter pipe 51, 53 or 52 for the small-diameter die $D_1$, $D_2$ or $D_3$ (FIG. 34, FIG. 33 or FIG. 35), and a position where the ends thereof are substantially contacted with the lifter pipe 59 for the large-diameter die $D_4$ (FIG. 36).

Of course, the present embodiment can be also applied to a case where punching is not performed by the die D, for example, laser processing is performed, by sliding the shutter elements 106 closer to each other to contact the corner tabs 106 with each other.

Note that the present embodiment can be also applied to a lifter pipe that has a different diameter from that of the lifter pipe 51, 53, 52 or 59 by adequately adjusting operational strokes of the second air cylinders (90).

[Sixth Embodiment]

Figure 37:
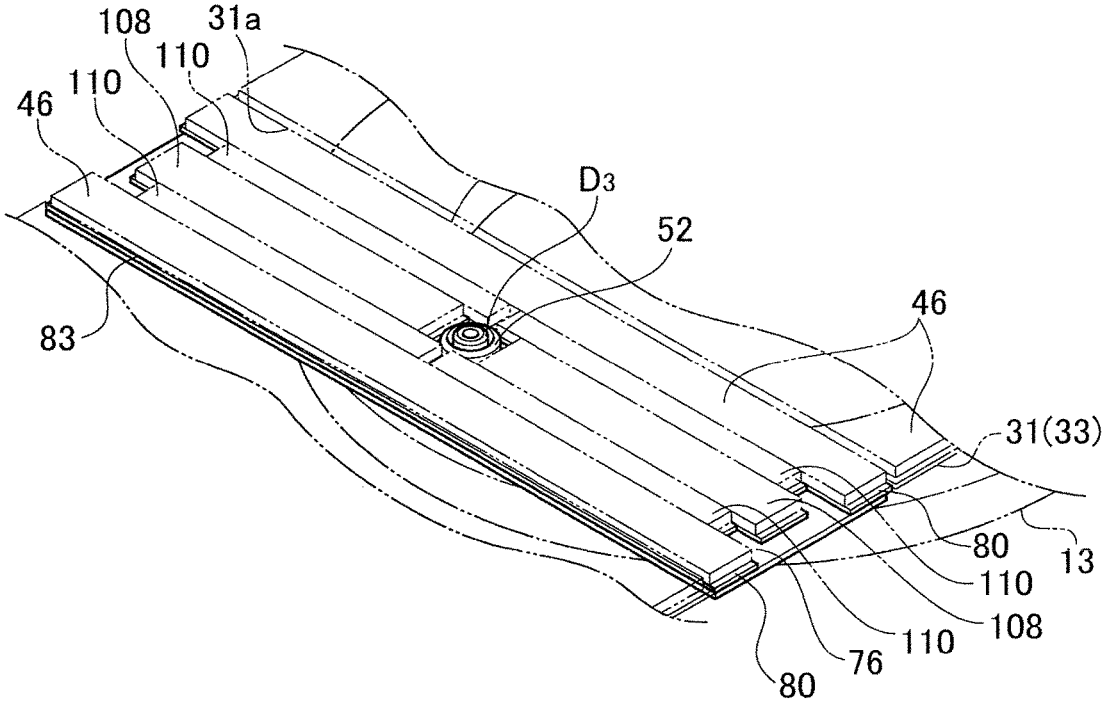
FIG. 37 It is a cross-sectional view showing a main portion of a punch press according to a sixth embodiment (when using a die $D_2$).

Next, a Sixth embodiment will be explained with reference to FIG. 37 to FIG. 40. In the present embodiment, two wide center shutter elements 108 and four shutter elements 110 disposed on both sides thereof. Note that FIG. 37 shows a case where punching is to be performed by the small-diameter die $D_3$ on the center track.

Each width of the shutter elements 108 along the Y-axis direction is almost identical to a diameter of the lifter pipe 52 that holds the die $D_3$, and each width of the shutter elements 110 along the Y-axis direction is almost half the width of the shutter elements 108 and almost identical to the width of the shutter elements 74 along the Y-axis direction in the third embodiments.

In addition, a slide mechanism for the shutter elements 108 and 110 is configured of six first air cylinders (84) for sliding the shutter elements 108 and 110 in the X-axis direction and two second air cylinders (90) each for sliding, on one side, all the first air cylinder (84) in the X-axis direction, similarly to the third embodiment.

Figure 38:
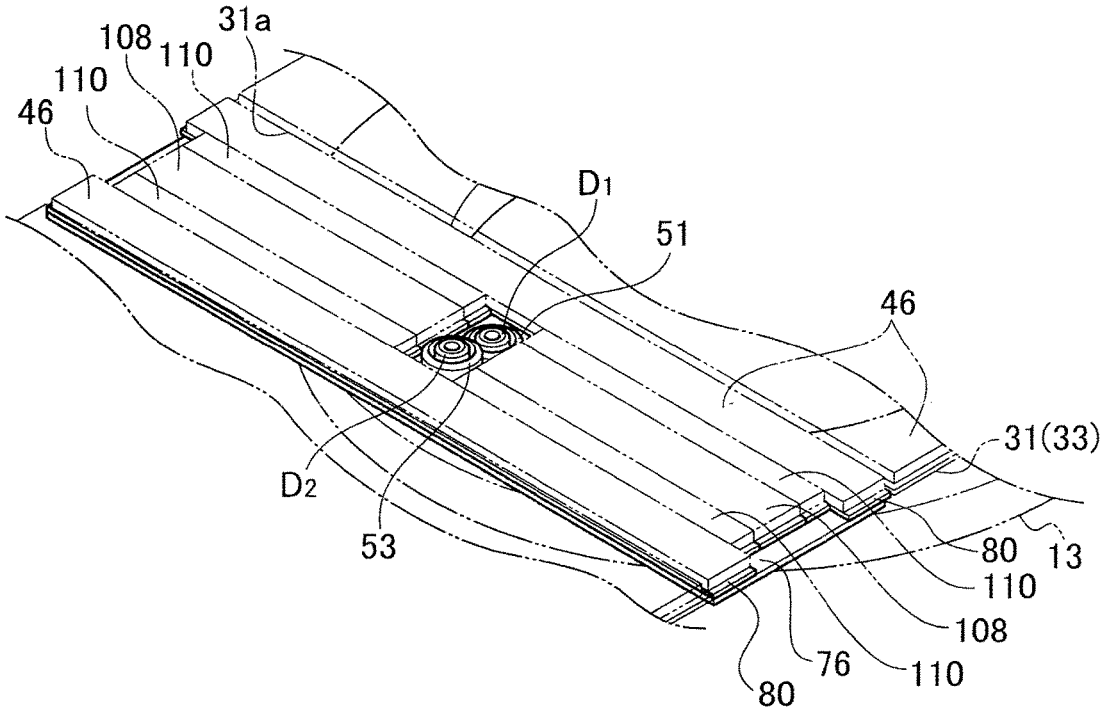
FIG. 38 It is a perspective view showing the main portion when using a die $D_2$.

In a case for punching by the die $D_2$, the ends of all the shutter elements 118 and 110 are almost contacted with (or made close to) the outer circumferential surface of the lifter pipe 53 that holds the die $D_2$ as shown in FIG. 38. Namely, the ends of the oppositely-located shutter elements 108 and 110 in the X-axis direction are distanced to each other so as to form a gap having a width almost equivalent to a diameter of the lifter pipe 53. In this case, the second air cylinders (90) are extended and all the first air cylinders (84) are shortened.

Here, the ends of the two shutter elements 110 associating with the die $D_1$ to be unused may be almost contacted with each other. According to this, the opened area can be made narrower.

Figure 39:
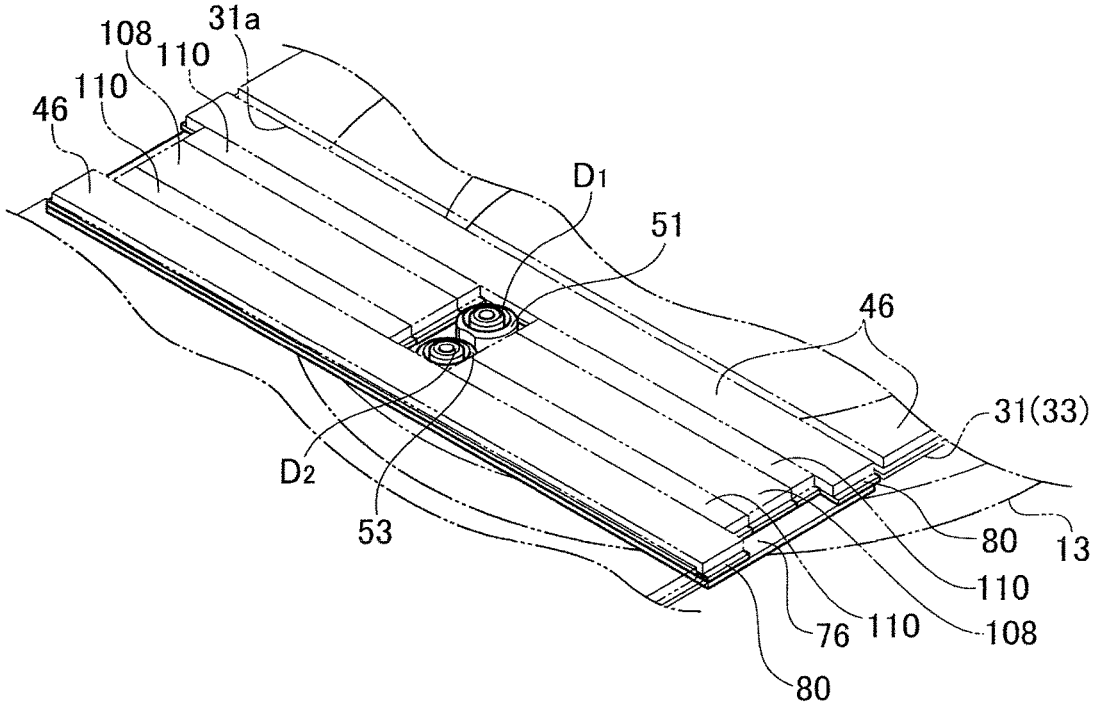
FIG. 39 It is a perspective view showing the main portion when using a die $D_1$.

In a case for punching by the die $D_1$, the ends of all the shutter elements 108 and 110 are almost contacted with (or made close to) the outer circumferential surface of the lifter pipe 51 that holds the die $D_1$ as shown in FIG. 39. Namely, the ends of the oppositely-located shutter elements 108 and 110 in the X-axis direction are distanced to each other so as to form a gap having a width almost equivalent to a diameter of the lifter pipe 51. Also in this case, the second air cylinders (90) are extended and all the first air cylinders (84) are shortened.

Here, the ends of the two shutter elements 110 associating with the die $D_2$ to be unused may be almost contacted with each other. According to this, the opened area can be made narrower.

Figure 40:
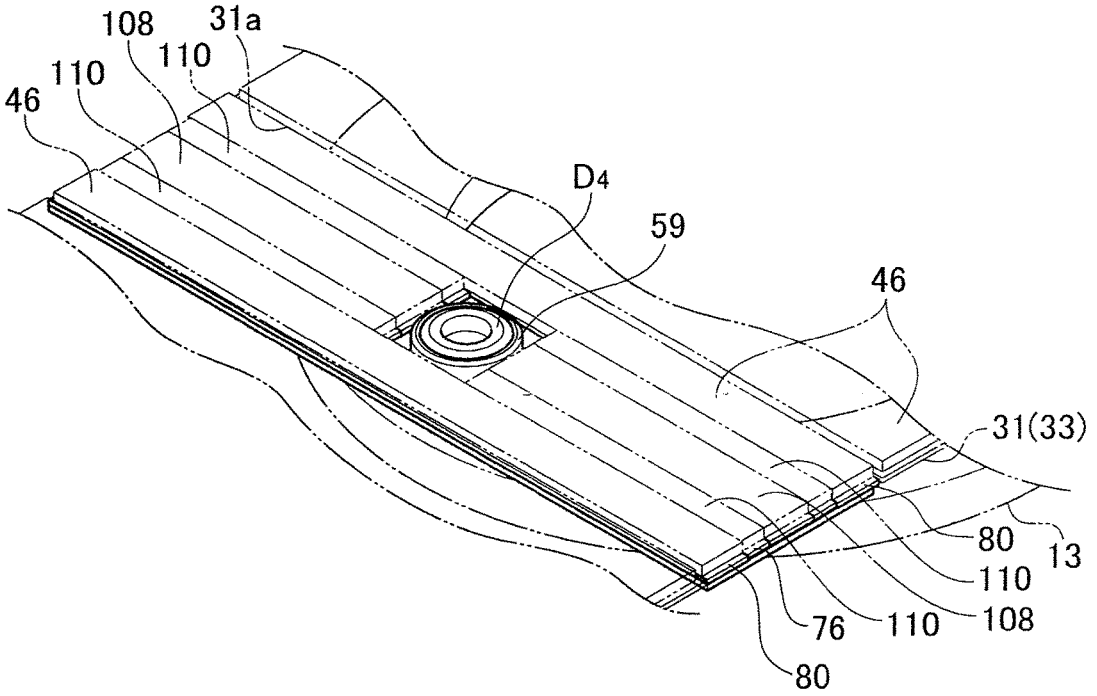
FIG. 40 It is a perspective view showing the main portion when using a die $D_3$.

In a case for punching by the large-diameter die $D_4$, the ends of all of the shutter elements 108 and 110 are almost contacted with (or made close to) the outer circumferential surface of the lifter pipe 59 that holds the die $D_4$ as shown in FIG. 40. Namely, the ends of the oppositely-located shutter elements 108 and 110 in the X-axis direction are distanced to each other so as to form a gap having a width almost equivalent to a diameter of the lifter pipe 59. In this case, the second air cylinders (90) are shortened and all the first air cylinders (84) are also shortened.

Of course, the present embodiment can be also applied to a case where punching is not performed by the die D, for example, laser processing is performed, similarly to FIG. 28(*a*) and FIG. 28(*b*). In this case, the ends of the oppositely-located shutter elements 108 and 110 are almost contacted with (or made close to) each other and an area at the work position is closed so that the dies) D can't enter thereto. At this moment, the second air cylinders (90) are extended and the first air cylinders (84) are also extended.

As explained above, the shutter elements 108 and 110 can be slid in two steps by the first and second air cylinders (84 and 90) in the present embodiment. The shutter elements 108 and 110 can be set three positions by being slid in two steps, a position where the ends thereof are substantially contacted with the lifter pipe 51, 53 or 52 for the small-diameter die $D_1$, $D_2$ or $D_3$ (FIG. 39, FIG. 38 or FIG. 37), a position where the ends thereof are substantially contacted with the lifter pipe 59 for the large-diameter die $D_4$ (FIG. 40), and a position where the ends thereof are substantially contacted with each other (not shown).

In addition, in the above embodiments, at least one pair of the shutter elements (the cover member elements) 74, 104, 106, 108 or 110 is provided on both sides of the entering area of the die(s) D within the opening 31*a* so as to be capable of being made distanced/closed to each other. Therefore, the pair of the shutter elements can be set at a position associating with the die D to be used easily and quickly by being shifted symmetrically with each other.

The invention claimed is:

1. A turret punch press which includes:

a frame, a rotatable lower turret that is rotatably connected to the frame and mounted with a plurality of dies, and a rotatable upper turret that is rotatably connected to the frame and mounted with a plurality of punches, the turret punch press punching a work by selected one of the plurality of punches and selected one of the plurality of dies at a work position, the turret punch press further comprising:

a plurality of die-support members being configured to slide tangentially with respect to the rotatable lower turret and in a direction toward the work position from a waiting position distanced from the work position by a guiding member and an actuator, so that selected one of the plurality of die-support members is positioned at the work position below the plurality of dies;

wherein the plurality of dies are provided on the rotatable lower turret along a circumferential direction thereof, the plurality of punches are provided along a circumferential direction of the rotatable upper turret, a plurality of tracks are concentrically provided on the rotatable lower turret and the rotatable upper turret, each of the plurality of dies is positioned on any one of the plurality of tracks of the lower turret, each of the plurality of punches is positioned on any one of the plurality of tracks of the upper turret, each of the die-support members is provided with a die supporter and a waiting-die supporter, the turret punch press further comprises a lifter for lifting the selected one of the plurality of the die-support members to be set at the work position, the die supporter is configured to lift up the selected one of the plurality of dies to a path line when the selected one of the die-support members is lifted up by the lifter so that the work can be punched, the waiting-die supporter is configured to locate a non-selected die at a lower level than the path line even when the selected one of the plurality of the die-support members is lifted up by the lifter, the die supporter and the waiting-die supporter are aligned, on each of the die-support members, radially with respect to the rotatable lower turret when located at the work position, one of the plurality of die-support members is provided with the die supporter at an outer track among the plurality of tracks of the rotatable lower turret, thereby the selected one of the plurality of dies positioned on the outer track is lifted to the path line when the selected one of the plurality of die-support members is lifted up by the lifter so that the work can be punched, and the other one of the plurality of the die-support members is provided with the die supporter at an inner track among the plurality of tracks of the rotatable lower turret, thereby the selected the other one of the plurality of dies positioned on the inner track is lifted to the path line when the other one of the plurality of die-support members is lifted up by the lifter so that the work can be punched.

2. The turret punch press according to claim 1, wherein the die supporter among the plurality of die supporters and the waiting-die supporter are integratedly provided on the one of the plurality of die-support members.

3. The turret punch press according to claim 1, wherein the lifter includes:

a cylindrical female thread member on whose inner circumferential surface female threads are formed; and a cylindrical lift ram formed with male threads which are meshed with the female threads formed on the inner circumferential surface of the cylindrical female thread member.

* * * * *